US011111891B2

(12) United States Patent
Sato et al.

(10) Patent No.: US 11,111,891 B2
(45) Date of Patent: Sep. 7, 2021

(54) FUEL SUPPLY DEVICE

(71) Applicant: DENSO CORPORATION, Kariya (JP)

(72) Inventors: Yuto Sato, Kariya (JP); Yuuji Hirata, Kariya (JP); Tsuyoshi Arai, Kariya (JP); Yukimasa Fukaya, Kariya (JP); Toshihiko Muramatsu, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/941,903

(22) Filed: Jul. 29, 2020

(65) Prior Publication Data

US 2020/0355149 A1 Nov. 12, 2020

Related U.S. Application Data

(63) Continuation of application No. PCT/JP2019/003093, filed on Jan. 30, 2019.

(30) Foreign Application Priority Data

Feb. 1, 2018 (JP) ..... JP2018-016355
Jan. 25, 2019 (JP) ..... JP2019-011338

(51) Int. Cl.
*F02M 37/10* (2006.01)
*F02M 59/44* (2006.01)

(52) U.S. Cl.
CPC ..... *F02M 37/103* (2013.01); *F02M 59/445* (2013.01)

(58) Field of Classification Search
CPC ..... F02M 37/103; F02M 59/445
See application file for complete search history.

(56) References Cited

U.S. PATENT DOCUMENTS 6,213,100 B1 * 4/2001 Johansen ..... B60K 15/035 123/509
2003/0002997 A1 * 1/2003 Hazama ..... F02M 37/103 417/360
2012/0060948 A1 * 3/2012 Okazono ..... F04B 23/021 137/565.17
2013/0061960 A1 * 3/2013 Jeon ..... F02M 37/103 137/544
2013/0098339 A1 * 4/2013 Yoon ..... F02M 37/04 123/495
2014/0166136 A1 * 6/2014 Okazono ..... B60K 15/077 137/565.24
2021/0033051 A1 * 2/2021 Ito ..... F16M 13/022

FOREIGN PATENT DOCUMENTS

JP 2012-207635 10/2012
JP 5462409 4/2014

* cited by examiner

*Primary Examiner* — Sizo B Vilakazi
(74) *Attorney, Agent, or Firm* — Nixon & Vanderhye P.C.

(57) ABSTRACT

A fuel supply device includes a flange, a pump unit, a supporting pillar, and a boss. The flange is attached to an opening portion of a fuel tank. The supporting pillar supports a sub tank such that the sub tank is positioned closer to and away from the flange. The boss is fixed at the flange and an end of the supporting pillar is inserted into the boss. The boss is made of a material different from that of the flange. The boss includes a stress concentration portion that is preferentially broken when a force equal to or greater than a predetermined value is applied to an end portion of the supporting pillar in an axis perpendicular direction.

12 Claims, 21 Drawing Sheets

FUEL SUPPLY DEVICE

CROSS REFERENCE TO RELATED APPLICATION

The present application is a continuation application of International Patent Application No. PCT/JP2019/003093 filed on Jan. 30, 2019, which designated the U.S. and claims the benefit of priority from Japanese Patent Application No. 2018-016355 filed on Feb. 1, 2018, and Japanese Patent Application No. 2019-011338 filed on Jan. 25, 2019. The entire disclosure of all of the above applications are incorporated herein by reference.

TECHNICAL FIELD

The present disclosure relates to a fuel supply device.

BACKGROUND ART

In a fuel supply device including a fuel pump disposed in a fuel tank, a supporting pillar connects a flange that is a lid of the fuel tank to a pump unit that includes the fuel pump. In the fuel supply device, the supporting pillar is press-fit into an inner tube of the flange.

SUMMARY

A fuel supply device of the present disclosure includes a flange, a pump unit, a supporting pillar, and a boss. The flange is attached to an opening portion of a fuel tank. The pump unit is disposed in the fuel tank and discharges a fuel out of the fuel tank. The supporting pillar connects the flange to the pump unit. The boss is fixed to the flange and the supporting pillar has one end inserted into the boss.

A direction perpendicular to an axial direction of the supporting pillar is defined as an axis perpendicular direction. The boss is made of a material different from that of the flange or the boss is formed as a different member from the flange. The boss includes a stress concentration portion to be preferentially broken when a force, in the axis perpendicular direction, having a predetermined value or more is applied to the other end of the supporting pillar.

BRIEF DESCRIPTION OF DRAWINGS

The above and other objects, features and advantages of the present disclosure will become more apparent from the following detailed description made with reference to the accompanying drawings.

DESCRIPTION OF EMBODIMENTS

Figure 1:
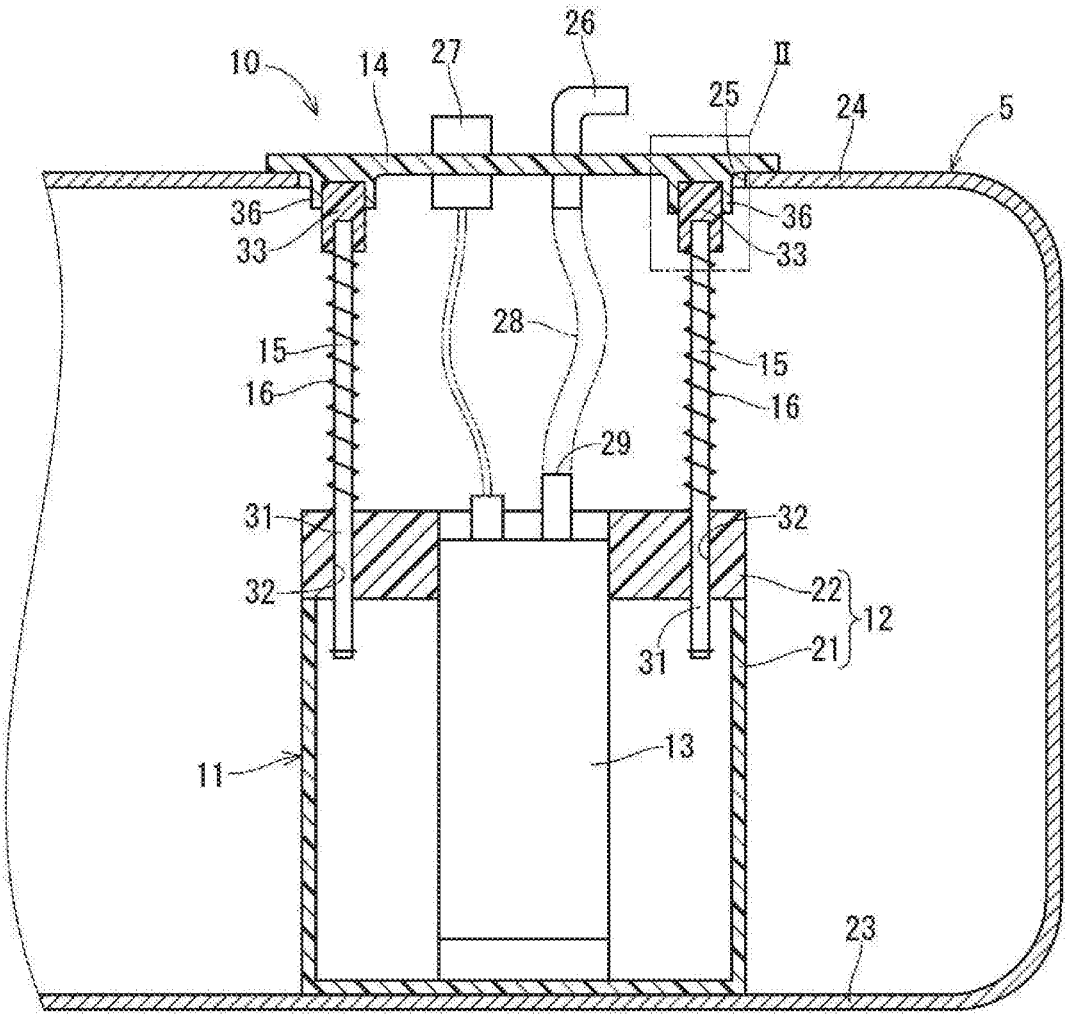
FIG. 1 is a cross-sectional view of a fuel supply device in a first embodiment and a fuel tank to which the fuel supply device is attached.

To begin with, examples of relevant techniques will be described.

In a fuel supply device including a fuel pump disposed in a fuel tank, a supporting pillar connects a flange that is a lid of the fuel tank to a pump unit that includes the fuel pump. In the fuel supply device, the supporting pillar is press-fit into an inner tube of the flange.

When a large impact is applied to the fuel tank due to a vehicle collision or the like, a large inertia force is applied to the pump unit. In addition to the inertia force, if a load generated when the fuel around the pump unit is shaken is applied to the flange through the supporting pillar, the flange may be broken. In this case, if a crack passing through the tank is generated in the flange, the fuel may leak from the fuel tank through the crack. The inner tube of the flange is integrally molded with a flange body with a resin. Thus, a crack generated at a root of the inner tube may pass through the fuel tank.

It is objective of the present disclosure to provide a fuel supply device that can restrict a fuel from leaking from a fuel tank.

A fuel supply device of the present disclosure includes a flange, a pump unit, a supporting pillar, and a boss. The flange is attached to an opening portion of a fuel tank. The pump unit is disposed in the fuel tank and discharges a fuel out of the fuel tank. The supporting pillar connects the flange to the pump unit. The boss is fixed to the flange and the supporting pillar has one end inserted into the boss.

A direction perpendicular to an axial direction of the supporting pillar is defined as an axis perpendicular direction. In a first aspect of the present disclosure, the boss is made of a material different from that of the flange. In a second aspect of the present disclosure, the boss is formed as a different member from the flange. The boss includes a stress concentration portion to be preferentially broken when a force, in the axis perpendicular direction, having a predetermined value or more is applied to the other end of the supporting pillar.

The boss has the stress concentration portion, and thus breakage of the boss occurs prior to the breakage of the flange when an excess amount of a load is applied to the fuel tank. The flange and the boss are made of different materials or formed as different members, thus a crack generated at the stress concentration portion stops expanding at a boundary between the boss and the flange. Therefore, a crack passing through the flange is restricted from generating and the fuel leakage from the fuel tank can be restricted.

Hereinafter, embodiments will be described according to the drawings. In the embodiments, substantially the same components are donated by the same reference numerals and description thereof is omitted. The drawings are schematically drawn for easy understanding of the configuration. The dimensions, angles, and dimensional ratios in the drawings are not necessarily limiting.

First Embodiment

A fuel supply device 10 in a first embodiment is illustrated in FIG. 1. The fuel supply device 10 is mounted in a fuel tank 5 of a vehicle and supplies a fuel to an outside of the fuel tank 5. FIG. 1 illustrates a state in which the fuel supply device 10 is mounted and an up-down direction in FIG. 1 is substantially the same as a vertical direction.

Basic Configuration

At first, a basic configuration of the fuel supply device 10 will be described. As shown in FIG. 1, the fuel supply device 10 includes a pump unit 11, a flange 14, supporting pillars 15, and springs 16. The pump unit 11 includes a sub tank 12 and a fuel pump 13.

The sub tank 12 is disposed in the fuel tank 5 and includes a case 21 and a lid 22. The case 21 is disposed on a bottom 23 of the fuel tank 5 and a fuel in the fuel tank 5 flows into the sub tank 12. The fuel pump 13 is housed in the sub tank 12 and discharges the fuel outward the fuel tank 5.

The flange 14 is shaped into a disc shape with a resin. The flange 14 is attached to an opening portion 25 of a ceiling 24 of the fuel tank 5 to liquid-tightly seal the opening portion 25. The flange 14 includes a fuel supply pipe 26 and an electrical connector 27. The fuel supply pipe 26 is connected to a discharging outlet 29 of the fuel pump 13 through a flexible tube 28, thus a fuel discharged out of the fuel pump 13 is guided to the outside of the fuel tank 5 through the fuel supply pipe 26. The electrical connector 27 includes a terminal therein to electrically connect the fuel pump 13 and a residual quantity detector (not shown) to an external member.

Each of the supporting pillars 15 is made, for example, of metal and connects the flange 14 to the pump unit 11. The supporting pillar 15 has an end portion 31 facing the pump unit 11 and being inserted into a through hole 32 of the sub tank 12. The supporting pillar 15 supports the sub tank 12 such that the sub tank 12 can be positioned close to and away from the flange 14. The springs 16 are respectively disposed outside of the supporting pillars 15 and bias the sub tank 12 against the bottom 23 of the fuel tank 5. Thus, a position of the sub tank 12 against the bottom 23 of the fuel tank 5 is stabilized regardless of a tolerance in manufacture and a deformation.

Fixing Structures of Supporting Pillars

Figure 2:
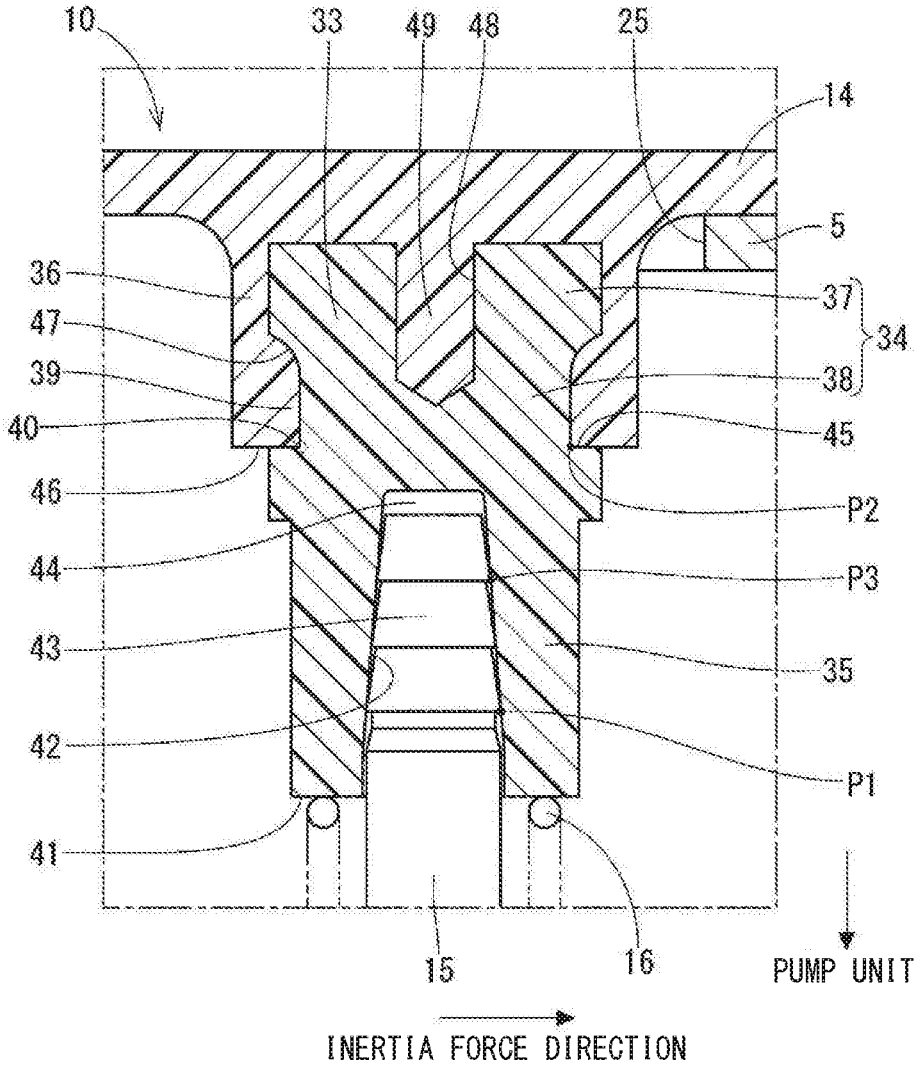
FIG. 2 is a partial enlarged view of portion II in FIG. 1.

Next, fixing structures of the supporting pillars 15 will be described with reference to FIGS. 1 and 2.

The flange 14 is a tank lid of the fuel tank 5. The tank lid needs a chemical resistance (in particular, an acid resistance) because the tank lid is exposed to an outside of the fuel tank 5. In contrast, a portion to which the supporting pillar 15 is fixed needs an impact resistance. The tank lid and the portion to which the supporting pillar 15 is fixed are often integrally molded with the same material. Thus, the material demands both of chemical resistance and impact resistance. However, an appropriate material having both resistances is not present actually, thus one of the resistances is often impaired.

In this embodiment, the fuel supply device 10 additionally includes the bosses 33 formed as a different member from the flange 14 as a portion to which the supporting pillars 15 are fixed. The flange 14 as a tank lid is made of a material having a high rigidity and being superior in chemical resistance and fuel resistance. Each of the bosses 33 is made of a material having a high toughness and being superior in fuel resistance. The material of the flange 14 may be polyphenylene sulfide-glass fiber (i.e., PPS-GF), polyphthalamide-glass fiber (i.e., PPA-GF), polyphenylene sulfide (i.e., PPS), polyphenylene sulfide in impact resistance (i.e., PPS-I that is elastomer modified), or polyphthalamide (i.e., PPA). The material of the boss 33 may be PPS, PPS-I, PPA, or POM. Thus, the flange 14 is restricted from cracking when the flange 14 is exposed to an acid liquid and the boss 33 can be improved in a durability against an external impact.

In this embodiment, a crack passing through the fuel tank 5 is restricted from generating in the flange 14 when a load caused by a vehicle collision is applied to the bosses 33 and the flange 14 through the supporting pillars 15. Structures of each of the bosses 33 and the like including a configuration to restrict the crack will be described in detail.

The bosses 33 are disposed between the flange 14 and the pump unit 11. Each of the bosses 33 includes a flange fixing member 34 and a supporting pillar fixing member 35.

The flange fixing member 34 is fixed to a supporter 36 of the flange 14. In the first embodiment, the flange fixing member 34 is integrally molded with the flange 14 by an insert molding when the flange 14 is molded. The flange fixing member 34 is embedded into the supporter 36. The supporter 36 is located between a body of the flange 14 and the pump unit 11 and has a tube shape to surround an outer periphery of the flange fixing member 34. The supporter 36 has a root having a round shape, i.e., the root of the supporter 36 has a curved surface in a vertical cross section.

The flange fixing member 34 has a large diameter portion 37 and a small diameter portion 38 located between the large diameter portion 37 and the pump unit 11. The flange fixing member 34 has an outer peripheral surface having a smaller diameter at a portion closer to the pump unit 11. The supporter 36 includes an inner annular protrusion 39 that protrudes toward the outer peripheral surface of the small diameter portion 38. The flange fixing member 34 has a corner 47 between the large diameter portion 37 and the small diameter portion 38 and the corner has a round shape. The corner 47 is an engaging portion that faces the pump unit 11 in an axial direction of the supporting pillar 15 and is engaged with the inner annular protrusion 39. Since the corner 47 is engaged with the inner annular protrusion 39, the boss 33 is prevented from slipping out. Hereinafter, the axial direction of the supporting pillar 15 is refereed as an axial direction.

The flange fixing member 34 includes a recess 48 recessed from a surface of the boss 33 facing the flange 14 in the axial direction. The recess 48 enables to reduce a difference of the thickness of the boss 33 as much as possible and improve a moldability of the boss 33. The flange 14 includes a protrusion 49 protruding into the recess 48.

The supporting pillar fixing member 35 protrudes from the flange fixing member 34 toward the pump unit 11. The supporting pillar fixing member 35 defines an insertion hole 42 that opens at an end surface 41 of the boss 33 facing the pump unit 11. The supporting pillar 15 has an end portion 43 facing the flange 14 and being inserted into the insertion hole 42. In the first embodiment, the insertion hole 42 has a tapered inner surface and the end portion 43 of the supporting pillar 15 has a fir tree shape. The fir tree shape is a shape in which multiple tapered surfaces are stacking in the axial direction. The end portion 43 of the supporting pillar 15 is press-inserted into the insertion hole 42 to fix the supporting pillar 15 to the boss 33. There is a cavity 44 defined between a bottom surface of the insertion hole 42 and an end surface of the end portion 43.

An outer diameter of a portion of the supporting pillar fixing member 35 closer to the flange fixing member 34 is larger than the small diameter portion 38. There is a step 45 between the supporting pillar fixing member 35 and the flange fixing member 34. The step 45 is a contact portion facing away from the pump unit 11 and being in contact with a flange end surface 46 of the supporter 36 in the axial direction.

The boss 33 and an outer surface of the supporting pillar 15 are in contact with each other at a contact portion having a first position P1 closest to the pump unit 11. The boss 33 and the flange 14 are in contact with each other at a contact portion having a second position P2 closest to the pump unit 11. The boss 33 and the outer surface of the supporting pillar 15 are in contact with each other at a contact portion having a third position P3 closest to the flange 14. The first position P1 and the third position P3 are located between the second position P2 and the pump unit 11 in the axial direction. The cavity 44 is defined between the third position P3 and the second position P2 in the axial direction.

Figure 3:
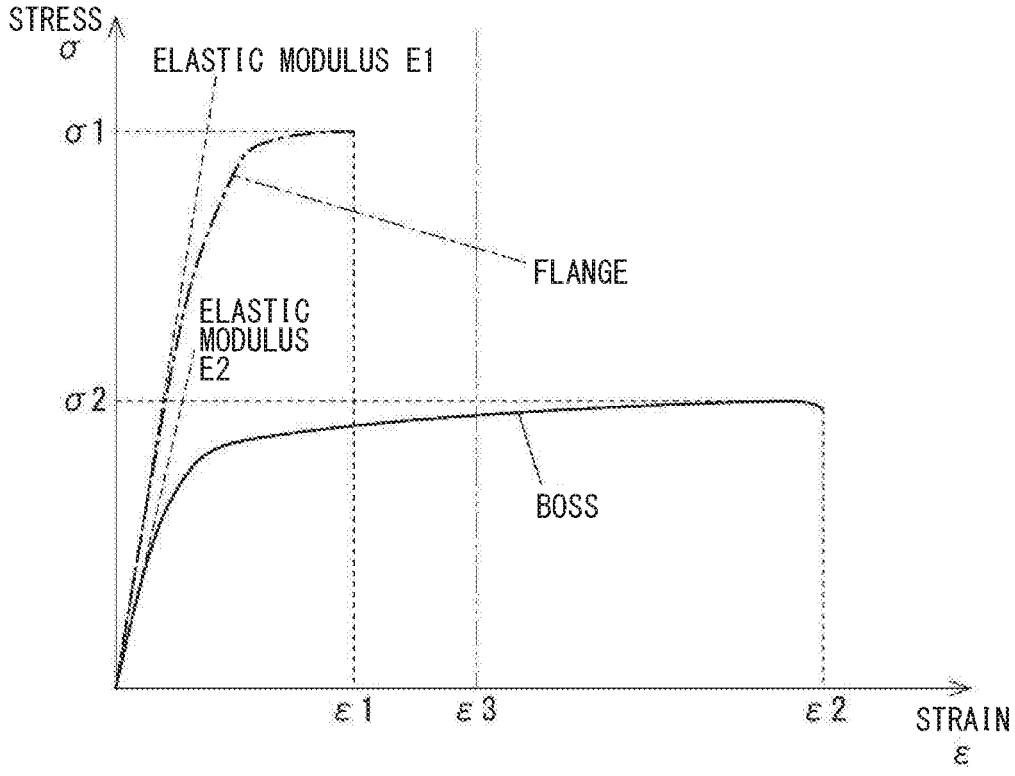
FIG. 3 is a stress-strain diagram of a material of a boss and a material of a flange.

The boss 33 is made of a different kind of resin from the flange 14. The materials of the boss 33 and the flange 14 are selected between materials satisfying the following conditions (A) to (E). The conditions (B) to (E) are described in FIG. 3.

(A) The material of the boss 33 has a melting temperature equal to or greater than a melting temperature of the material of the flange 14.

(B) The material of the boss 33 has a breaking strength $\sigma 2$ less than a breaking strength $\sigma 1$ of the material of the flange 14.

(C) The material of the boss 33 has an elastic modulus E2 less than an elastic modulus E1 of the material of the flange 14.

(D) The material of the boss 33 has a breaking elongation $\varepsilon 2$ greater than a breaking elongation $\varepsilon 1$ of the material of the flange 14.

(E) The breaking elongation $\varepsilon 2$ of the material of the boss 33 is greater than a predetermined breaking elongation $\varepsilon 3$. The predetermined breaking elongation $\varepsilon 3$ is a value required to restrict a crack of the supporting pillar 15 generated when press-fit and a decrease in a force required to draw the supporting pillar 15.

When a large impact force is applied to the fuel tank 5 due to a vehicle collision, both of an inertia force acting on the pump unit 11 and a load generated when the fuel around and inside the pump unit 11 is shaken are applied to the end portion 31 of the supporting pillar 15 in a direction perpendicular to the axis of the supporting pillar 15 (hereinafter, referred as an axis perpendicular direction). Since these forces have the supporting pillar 15 tilt relative to the end portion 43 as a fulcrum point, the boss 33 and the flange 14 that are supporting structures of the end portion 43 receive the forces. The boss 33 includes a stress concentration portion 40 that is preferentially broken when a force having a predetermined value or more in the axis perpendicular direction is applied to the end portion 31 of the supporting pillar 15.

In the first embodiment, when a force in the axis perpendicular direction is applied to the end portion 31, the corner 47 that is located at a side of the stress concentration portion 40 opposite to the pump unit 11 is engaged with the inner annular protrusion 39, so that the large diameter portion 37 resists against a tilt of the supporting pillar 15. Additionally, the step 45 is in contact with the flange end surface 46 of the supporter 36 and restricts the flange fixing member 34 (i.e., a portion of the boss 33 located between the step 45 and the flange 14) and the supporter 36 from being tilted. The third position P3 is closer to the pump unit 11 than the second position P2 and the stress concentration portion 40 in the axial direction. The cavity 44 is defined between the third position P3 and the second position P2 in the axial direction. Thus, the boss 33 receives a force to have the boss 33 bend around a portion of a corner of the step 45 as a fulcrum point in a direction in which the inertia force is applied (hereinafter, refereed as an inertia force direction). Therefore, a stress is concentrated on a portion of the corner of the step 45 that is located opposite to the fulcrum point of bending in the inertia force direction, has a smallest outer diameter (hereinafter referred as a smallest diameter portion), and is outside of a press-fit area of the boss 33 in which the supporting pillar 15 is press-fit into the boss 33. That is, the portion of the corner of the step 45 serves as the stress concentration portion 40. A portion outside the press-fit area is a range that is not overlapped with a portion of the boss 33 into which the supporting pillar 15 is press-fit in the axial direction. Because of this and the conditions (B) and (C) for selecting the materials, the stress concentration portion 40 of the boss 33 is broken prior to the flange 14 when a force having a predetermined value or more is applied to the end portion 31 in the axis perpendicular direction.

As described above, in the first embodiment, the fuel supply device 10 includes the sub tank 12, the fuel pump 13, the flange 14, the supporting pillars 15, and the bosses 33. The flange 14 is attached to the opening portion 25 of the fuel tank 5. The supporting pillars 15 support the sub tank 12 such that the sub tank 12 can be positioned close to and away from the flange 14. The bosses 33 are fixed to the flange 14 and the end portions 43 of the supporting pillars 15 are respectively inserted into the bosses 33. Each of the bosses 33 is made of a material different from that of the flange 14 and has the stress concentration portion 40 that is selectively broken when a force having a predetermined value or more in the axis perpendicular direction is applied to the end portion 31 of the supporting pillar 15.

Each of the bosses 33 includes the stress concentration portion 40, and therefore breakage of the bosses 33 occurs prior to the breakage of the flange 14 when an excess amount of load is applied to the fuel supply device 10. The flange 14 and the boss 33 are made of different materials, thus a crack generated at the stress concentration portion 40 stops expanding at a boundary between the boss 33 and the flange 14. As a result, the crack passing through the flange 14 is restricted from generating, which restricts the fuel from leaking from the fuel tank 5.

In the first embodiment, since the material of the boss 33 has a melting temperature equal to or higher than a melting temperature of the material of the flange 14, the boss 33 is restricted from melting and deforming when the boss 33 is inserted into the flange and molded. Thus, the crack at the stress concentration portion 40 can be stopped expanding at the boundary between the boss 33 and the flange 14.

In the first embodiment, the material of the boss 33 has the breaking strength $\sigma 2$ less than the breaking strength $\sigma 1$ of the material of the flange 14. Thus, the boss 33 is preferentially broken when an impact energy is applied.

In the first embodiment, the material of the boss 33 has the elastic modulus E2 less than the elastic modulus E1 of the material of the flange 14. Thus, the boss 33 is preferentially deformed so that the flange 14 can be prevented from receiving an excess amount of force.

In the first embodiment, the material of the boss 33 has the breaking elongation $\varepsilon 2$ greater than the breaking elongation $\varepsilon 1$ of the material of the flange 14. Thus, the supporting pillar 15 is restricted from cracking when press-fit into the boss 33 and a force required to draw the supporting pillar 15 can be prevented from decreasing. In addition, an impact resistance is secured and a design flexibility is improved.

In the first embodiment, the first position P1 is located between the second position P2 and the pump unit 11. The third position P3 is located between the second position P2 and the pump unit 11. Thus, when the force in the axis perpendicular direction is applied to the end portion 31 of the supporting pillar 15, the boss 33 receives the force to have the boss 33 bend at the second position P2 relative to the first position P1 and the third position P3. Thus, the boss 33 can be broken when the excess amount of the load is applied.

In the first embodiment, the stress concentration portion 40 is the smallest outer diameter portion of the boss 33 that is outside of the press-fit area. The corner of the step 45 serves as the stress concentration portion 40. When the force in the axis perpendicular direction is applied to the end portion 31 of the supporting pillar 15, the boss 33 receives a force to have the boss 33 bend around the portion of the corner of the step 45 in the inertia force applying direction. As a result, a stress can be concentrated on the stress concentration portion 40 (i.e., the corner of the step 45) that is located opposite to the fulcrum point of bending in the inertia force applying direction.

In the first embodiment, the boss 33 includes the corner 47 that faces the pump unit 11 and is engaged with the flange 14. The corner 47 is located at a side of the stress concentration portion 40 opposite to the pump unit 11. When a force in the axis perpendicular direction is applied to the end portion 31, the large diameter portion 37 resists against a tilt of the supporting pillar 15 by the corner 47 engaging with the inner annular protrusion 39. Thus, the boss 33 is likely to bend at a position between the large diameter portion 37 and the press-fit area of the boss 33, and the boss 33 can be preferentially broken when the excess amount of the load is applied.

In the first embodiment, the boss 33 includes the flange fixing member 34 embedded in the supporter 36 of the flange 14 and the supporting pillar fixing member 35 protruding from the supporter 36 toward the pump unit 11. The supporting pillar fixing member 35 includes the step 45 that faces away from the pump unit 11 and is in contact with the flange end surface 46 of the supporter 36. Thus, when the force in the axis perpendicular direction is applied to the end portion 31, the step 45 is pressed against the flange end surface 46 of the supporter 36, which restricts the flange fixing member 34 and the supporter 36 from being tilted. In contrast, the boss 33 is bent at a position, as a fulcrum point, around the corner of the step 45 in the inertia force applying direction. Thus, a stress is concentrated on the corner of the step 45 located opposite to the fulcrum point of bending in the inertia force applying direction. Since the boss 33 is not tilted but is bent, a stress at the supporter 36 of the flange 14 is reduced and a thickness of the supporter 36 can be made relatively thinner.

Second Embodiment

Figure 4:
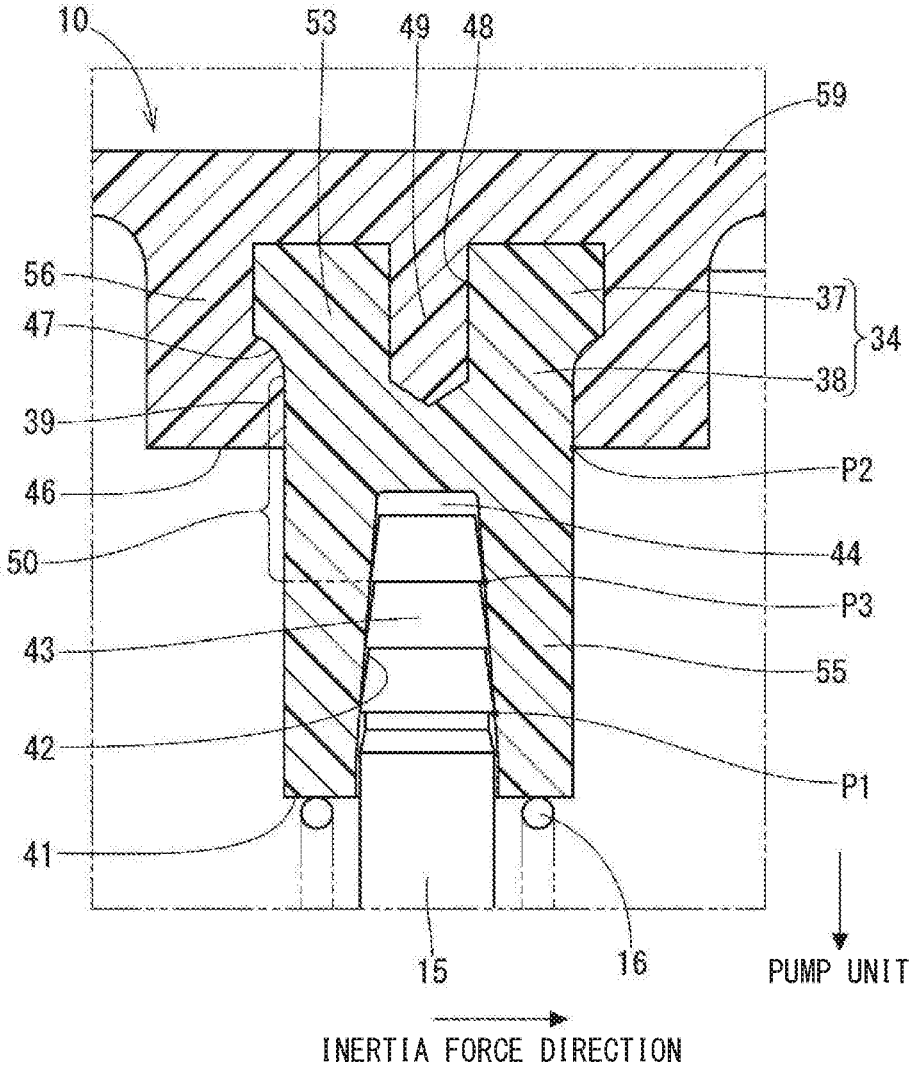
FIG. 4 is a cross-sectional view illustrating a portion around a boss of a fuel supply device in a second embodiment.

In a second embodiment, as shown in FIG. 4, an outer diameter of a supporting pillar fixing member 55 of a boss 53 is substantially the same as the outer diameter of the small diameter portion 38. There is no steps between the supporting pillar fixing member 55 and the small diameter portion 38. When a force in the axis perpendicular direction is applied to the end portion 31 of the supporting pillar 15, the large diameter portion 37 resists against a tilt of the supporting pillar 15 by the corner 47 engaging with the inner annular protrusion 39. Thus, the boss 53 is bent at a position between the large diameter portion 37 and a press-fit area of the boss 53 in which the supporting pillar 15 is press-fit into the boss 53. A stress is concentrated on an area, in the axial direction, that has the smallest outer diameter and that is outside of the press-fit area (i.e., an area of the small diameter portion 38 between a flange 59 and the third position P3). That is, the area serves as a stress concentration portion 50. The flange 59 has a supporter 56 having a relatively greater thickness to resist against the tilt of the boss 53. In the second embodiment, a crack passing through the flange 59 is restricted from generating as with the first embodiment, which restricts the fuel from leaking out of the fuel tank 5.

Third Embodiment

Figure 5:
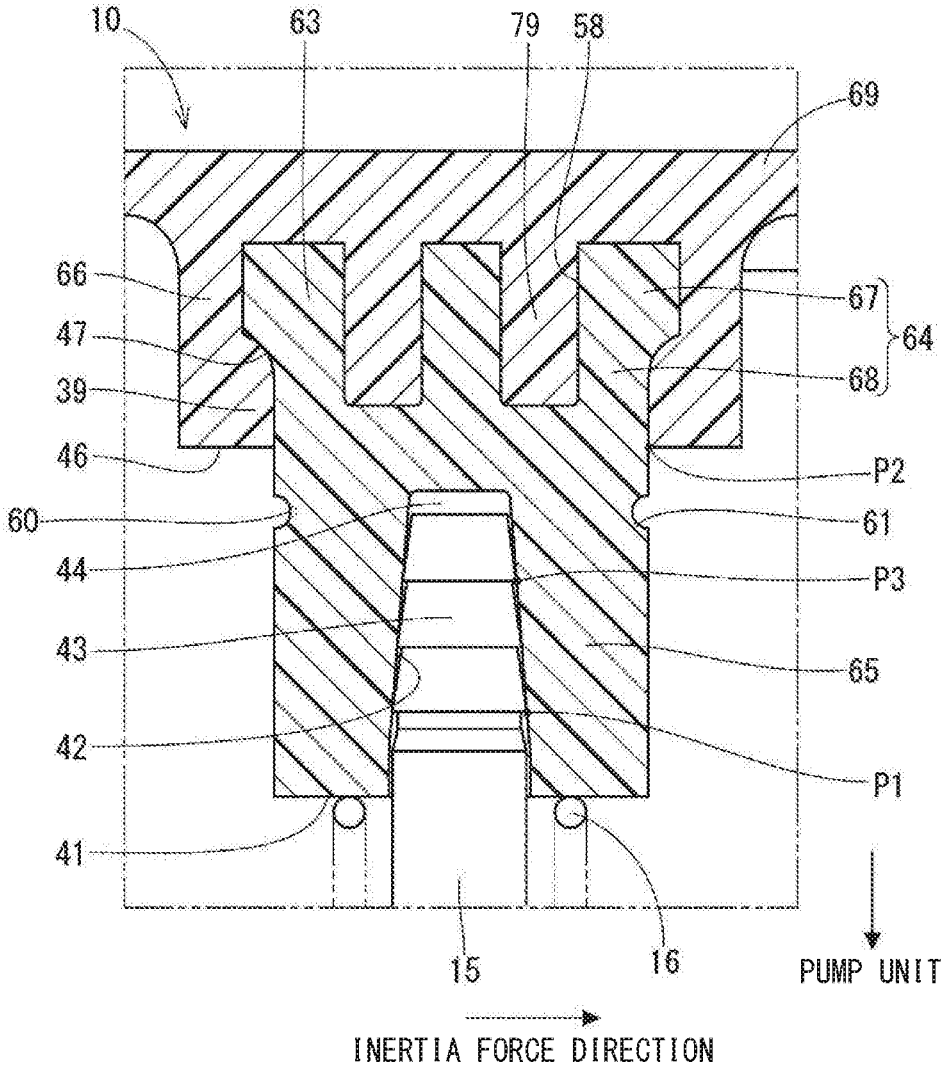
FIG. 5 is a cross-sectional view illustrating a portion around a boss of a fuel supply device in a third embodiment.

In a third embodiment, as shown in FIG. 5, a boss 63 includes a cutout portion 61 having an annular shape. The cutout portion 62 is located at an outer wall of a supporting pillar fixing member 65 of the boss 63. When a force in the axis perpendicular direction is applied to the end portion 31 of the supporting pillar 15, a large diameter portion 67 resists against a tilt of the supporting pillar 15 by the corner 47 engaging with the inner annular protrusion 39. As a result, the boss 63 is bent at a position between the large diameter portion 67 and a press-fit area in which the supporting pillar 15 is press-fit into the boss 63 and a stress is concentrated on a bottom of the cutout portion 61 that has the smallest outer diameter and is outside of the press-fit area. That is, the bottom of the cutout portion 61 serves as a stress concentration portion 60. The stress concentration portion 60 and the cavity 44 are located between the third position P3 and the second position P2 in the axial direction. The boss 63 has a relatively larger diameter at a position corresponding to the cutout portion 61 to restrict a decrease in an impact resistance caused by having the cutout portion 61. Similarly, the large diameter portion 67 and a small diameter portion 68 of a flange fixing member 64 and a supporter 66 of the flange 69 have relatively large diameters. The flange fixing member 64 includes a recess 58 recessed from a surface of the boss 63 facing the flange 69 in the axial direction, and the recess 58 has an annular shape. The flange 69 includes an annular protrusion 79 protruding into the recess 58. In the third embodiment, a crack passing through the flange 69 is restricted from generating as with the first embodiment, which restricts the fuel from leaking out of the fuel tank 5.

Fourth Embodiment

Figure 6:
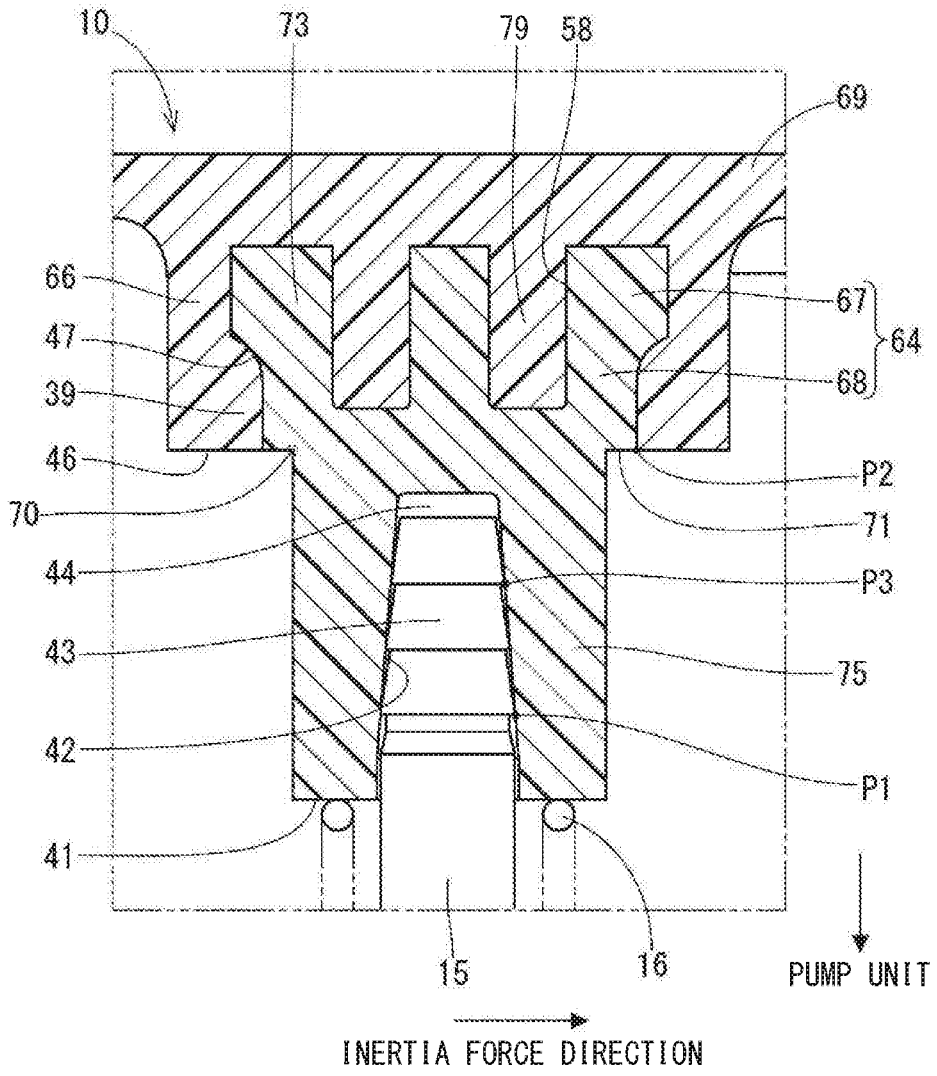
FIG. 6 is a cross-sectional view illustrating a portion around a boss of a fuel supply device in a fourth embodiment.

In a fourth embodiment, as shown in FIG. 6, a supporting pillar fixing member 75 of a boss 73 has a smaller diameter than the small diameter portion 68. There is a step 71 between the supporting pillar fixing member 75 and the small diameter portion 68. When a force in the axis perpendicular direction is applied to the end portion 31 of the supporting pillar 15, the large diameter portion 67 resists against the tilt of the supporting pillar 15 by the corner 47 engaging with the inner annular protrusion 39. The boss 73 is bent at a position between the large diameter portion 67 and a press-fit area in which the supporting pillar 15 is press-fit into the boss 73. A stress is concentrated on a corner of the step 71 between the supporting pillar fixing member 75 and the small diameter portion 68 that has a smallest outer diameter and is outside of the press-fit area of the boss 73. The corner of the step 71 serves as a stress concentration portion 70. The stress concentration portion 70 and the cavity 44 are located between the third position P3 and the second position P2 in the axial direction. In the fourth embodiment, a crack passing through the flange 69 is restricted from generating as with the first embodiment, which restricts the fuel from leaking out of the fuel tank 5.

Fifth Embodiment

Figure 7:
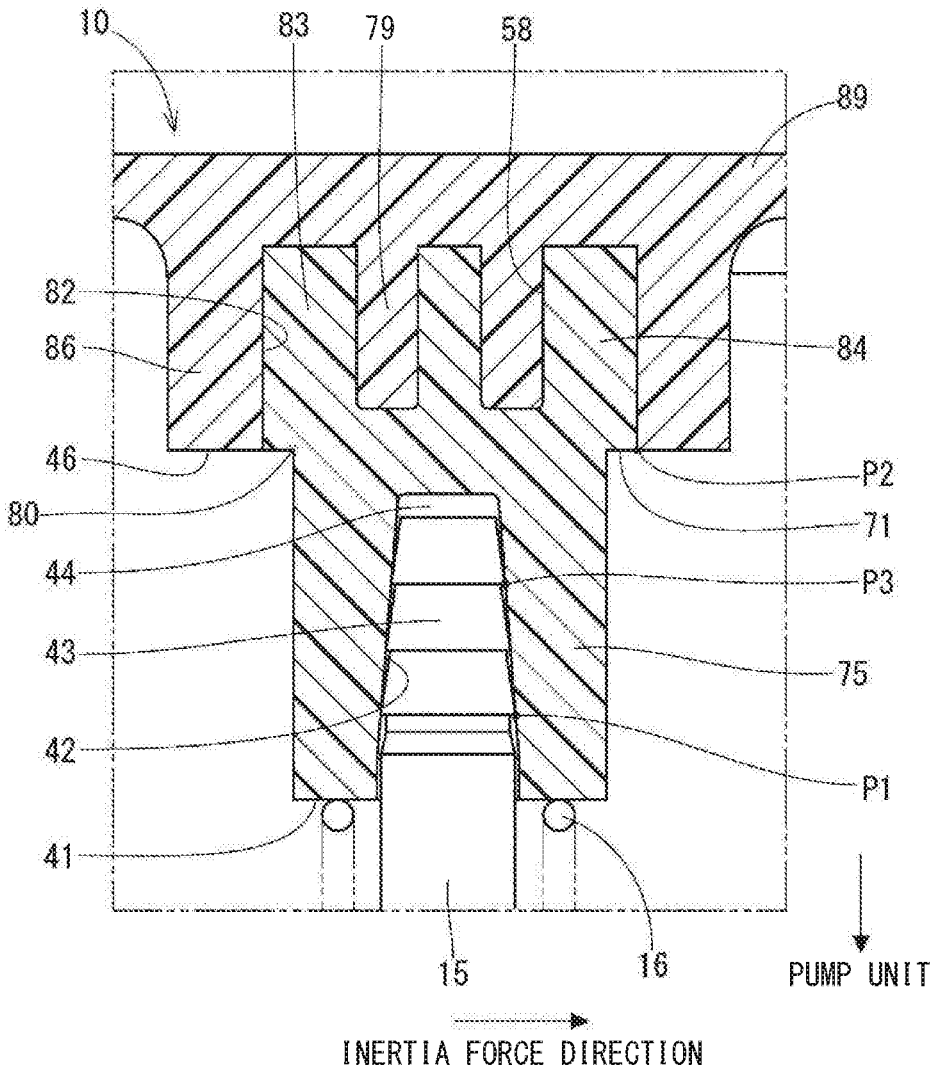
FIG. 7 is a cross-sectional view illustrating a portion around a boss of a fuel supply device in a fifth embodiment.

In a fifth embodiment, as shown in FIG. 7, a supporter 86 of a flange 89 defines an insertion hole 82 and a flange fixing member 84 of a boss 83 is press-fit into the insertion hole 82. There is a step 71 between the flange fixing member 84 and a supporting pillar fixing member 75. When a force in the axis perpendicular direction is applied to the end portion 31 of the supporting pillar 15, the boss 83 is bent around a corner of the step 71, as a fulcrum point, located between the flange fixing member 84 and the supporting pillar fixing member 75. As a result, a stress is concentrated on the corner of the step 71 that has the smallest outer diameter and is outside of a press-fit area in which the supporting pillar 15 is press-fit into the boss 83. That is, the corner serves as a stress concentration portion 80. The stress concentration portion 80 and the cavity 44 are located between the third position P3 and the second position P2 in the axial direction. In the fifth embodiment, a crack passing through the flange 89 is restricted from generating as with the first embodiment, which restricts the fuel from leaking out of the fuel tank 5.

Sixth Embodiment

Figure 8:
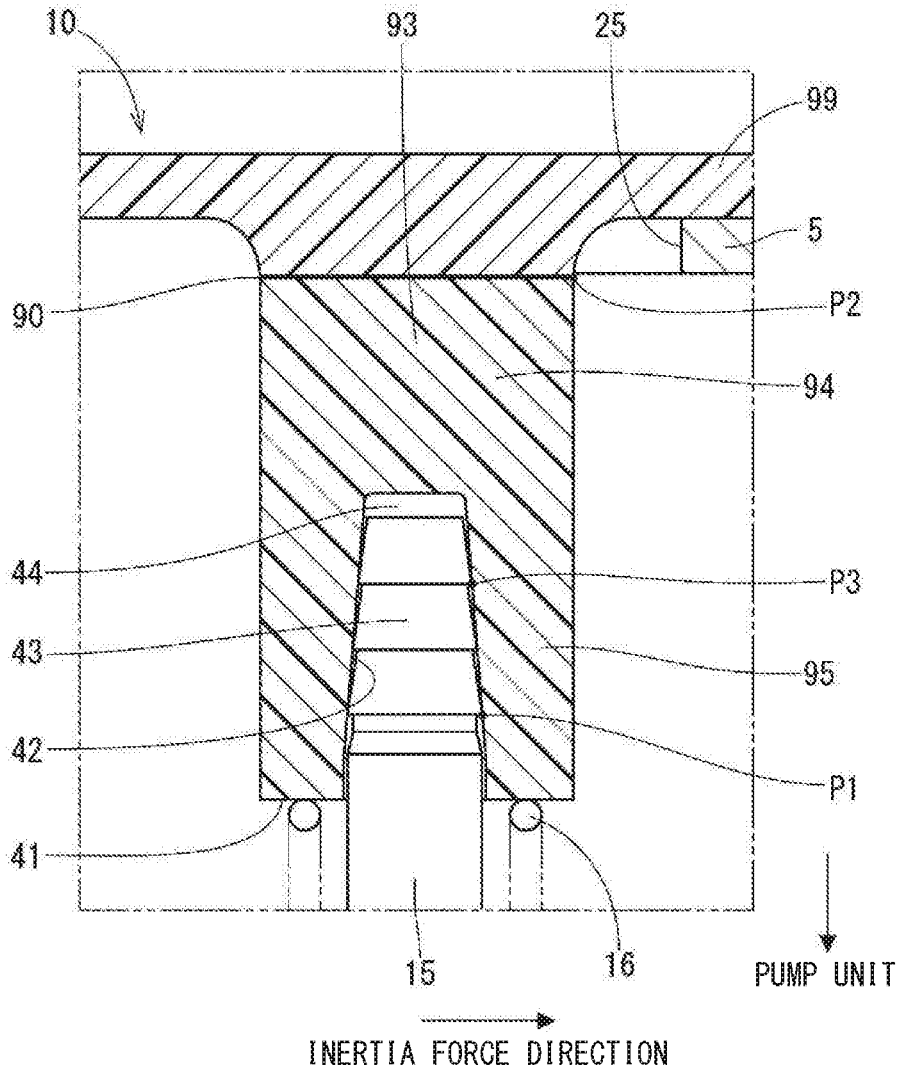
FIG. 8 is a cross-sectional view illustrating a portion around a boss of a fuel supply device in a sixth embodiment.

In a sixth embodiment, as shown in FIG. 8, a flange fixing member 94 of a boss 93 is fixed to a flange 99 by welding. The flange fixing member 94 has an outer diameter substantially the same as that of a supporting pillar fixing member 95. There is no steps between the flange fixing member 94 and the supporting pillar fixing member 95. When a force in the axis perpendicular direction is applied to the end portion 31 of the supporting pillar 15, a stress is concentrated on a welding portion of the flange fixing member 94. That is, the welding portion serves as a stress concentration portion 90. In the sixth embodiment, a crack passing through the flange 99 is restricted from generating as with the first embodiment, which restricts the fuel from leaking out of the fuel tank 5.

Other Embodiment

Figure 9:
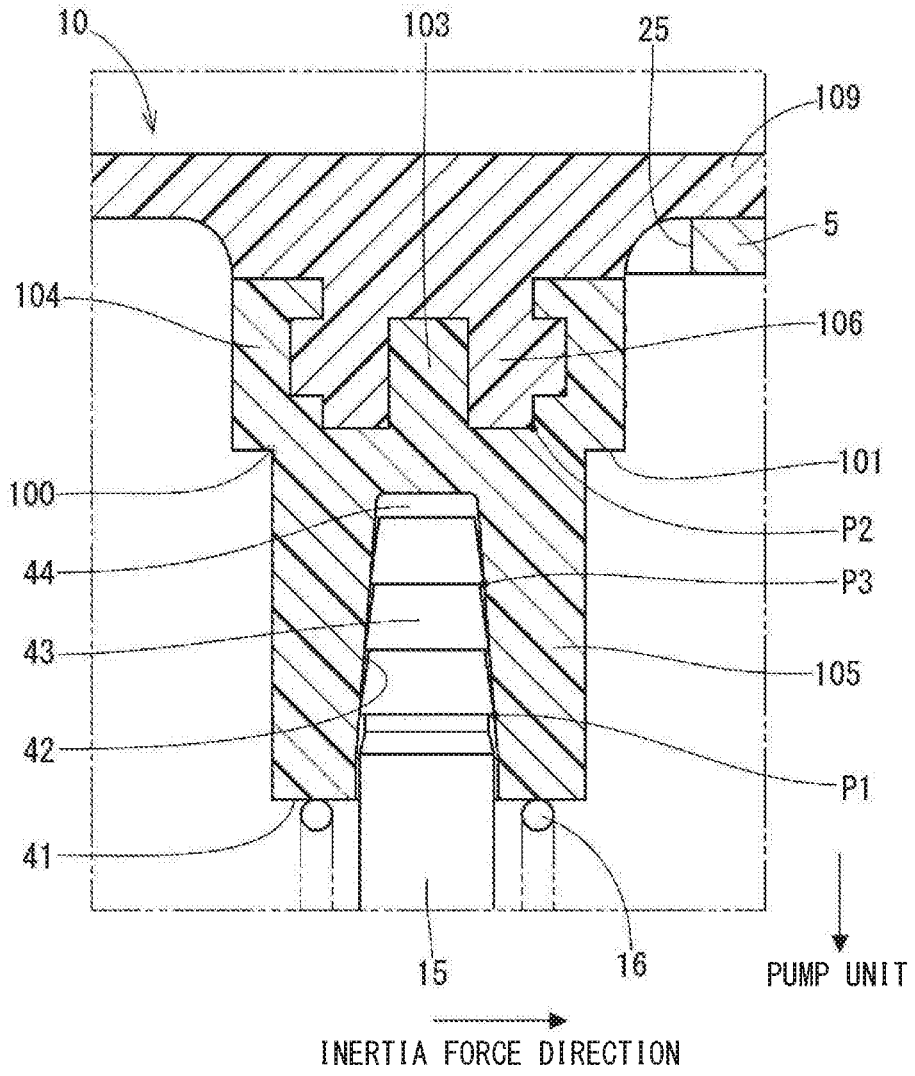
FIG. 9 is a cross-sectional view illustrating a portion around a boss of a fuel supply device in another example of the first embodiment.

In other embodiment, as shown in FIG. 9, a boss 103 may be fixed to a flange 109 by embedding a supporter 106 of the flange 109 into a flange fixing member 104. The flange fixing member 104 has a tube shape surrounding an outer surface of the supporter 106. The flange fixing member 104 has an inner wall having an engaging portion engaging with the supporter 106 in the axial direction. The boss 103 has a step 101 between the flange fixing member 104 and a supporting pillar fixing member 105 and a corner of the step 101 serves as a stress concentration portion 100.

Figure 10:
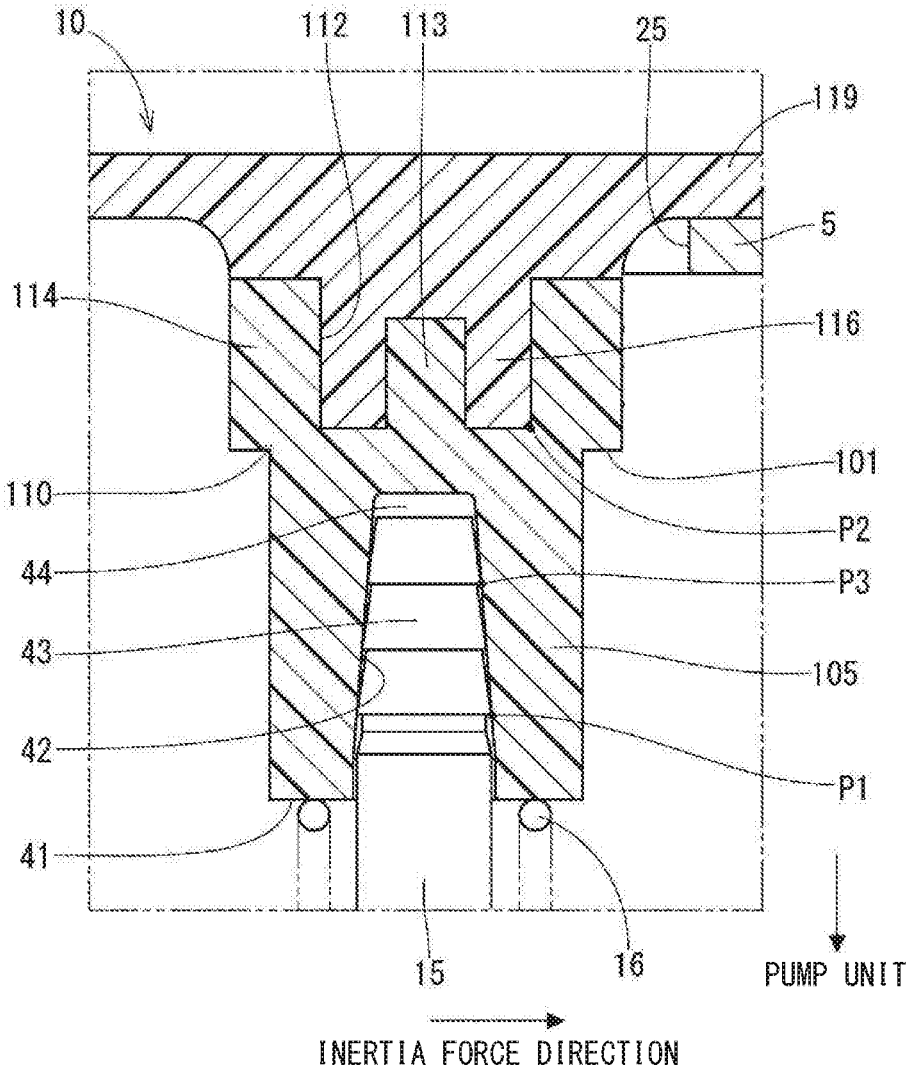
FIG. 10 is a cross-sectional view illustrating a portion around a boss of a fuel supply device in another example of the first embodiment.

In other embodiment, as shown in FIG. 10, a flange fixing member 114 includes an insertion hole 112 and a boss 113 may be fixed to a flange 119 such that a supporter 116 of the flange 119 is press-fit into or welded to the insertion hole 112. The flange fixing member 114 has a tube shape surrounding an outer surface of the supporter 116. The boss 113 has the step 101 located between the flange fixing member 114 and the supporting pillar fixing member 105 and a corner of the step 101 serves as a stress concentration portion 110.

Figure 11:
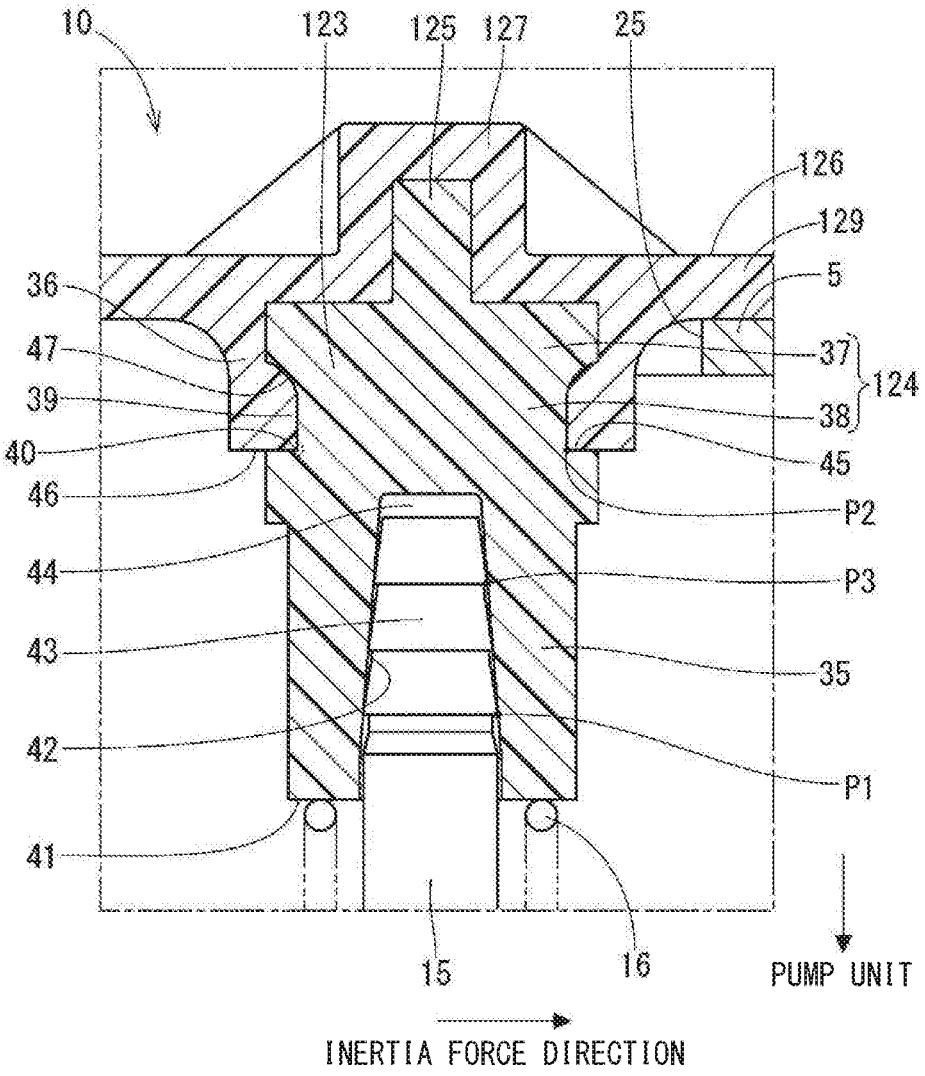
FIG. 11 is a cross-sectional view illustrating a portion around a boss of a fuel supply device in another example of the first embodiment.

In another example of the first embodiment, as shown in FIG. 11, a flange fixing member 124 of a boss 123 may include a protrusion 125 protruding from a surface of the flange fixing member facing a flange 129 in the axial direction. The protrusion 125 protrudes over an upper surface 126 of the flange 129. The flange 129 includes a tubular protrusion 127 formed into a tube shape to surround an outer surface and a tip end of the protrusion 125.

Figure 12:
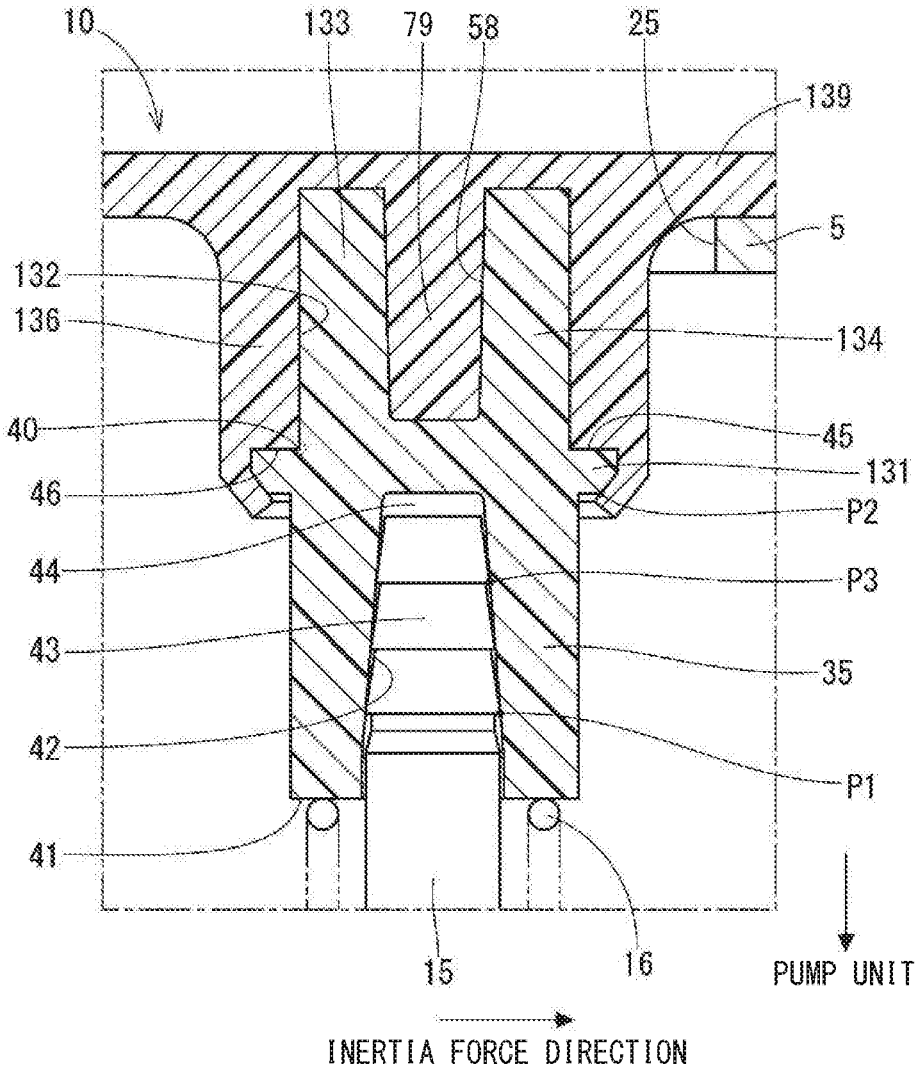
FIG. 12 is a cross-sectional view illustrating a portion around a boss of a fuel supply system in another embodiment.

In other embodiment, as shown in FIG. 12, a supporter 136 of a flange 139 defines an insertion hole 132 into which a flange fixing member 134 of a boss 133 is press-fit and the boss 133 includes a collar 131. The supporter 136 may be heat caulked with the collar 131 of the boss 133 to overlay the collar 131.

Figure 13:
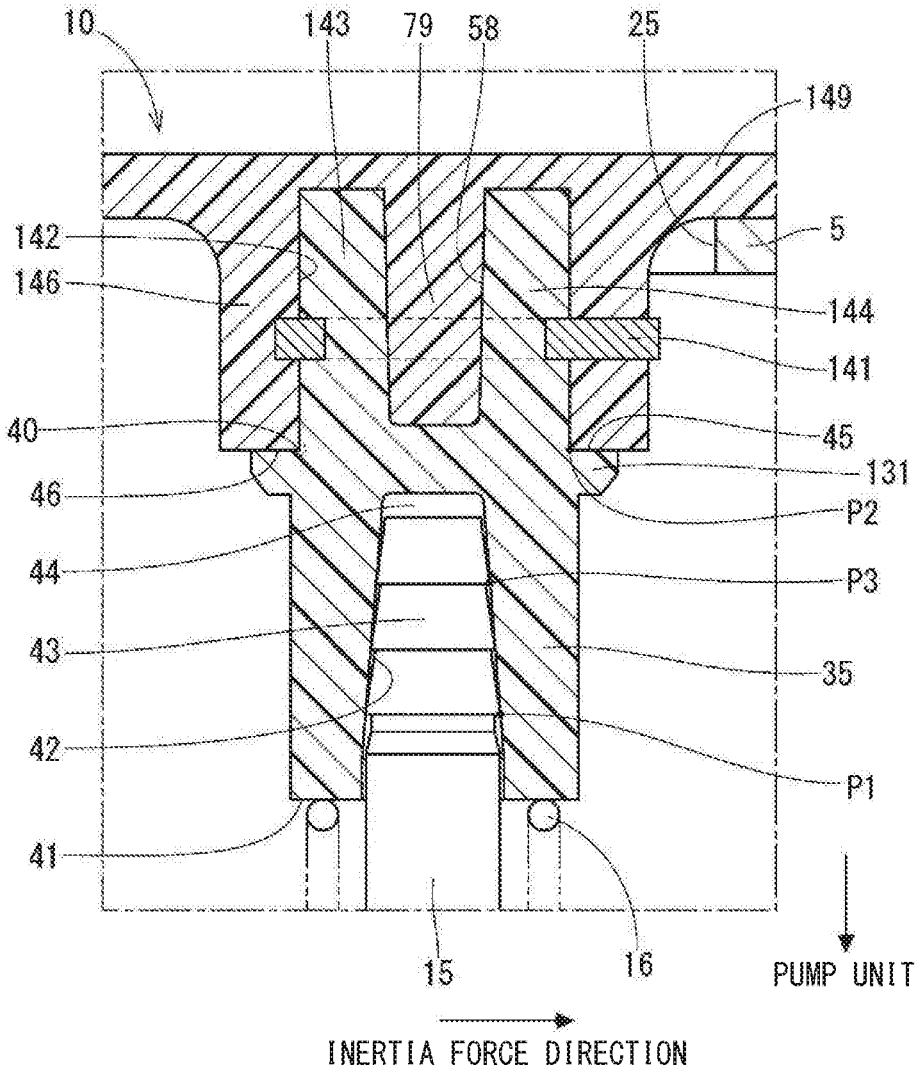
FIG. 13 is a cross-sectional view illustrating a portion around a boss of a fuel supply device in another embodiment.

In other embodiment, as shown in FIG. 13, a supporter 146 of a flange 149 includes an insertion hole 142. A flange fixing member 144 of a boss 143 may be press-fit into the insertion hole 142 and prevented from slipping out with a snap ring 141 such as an E ring.

Figure 14:
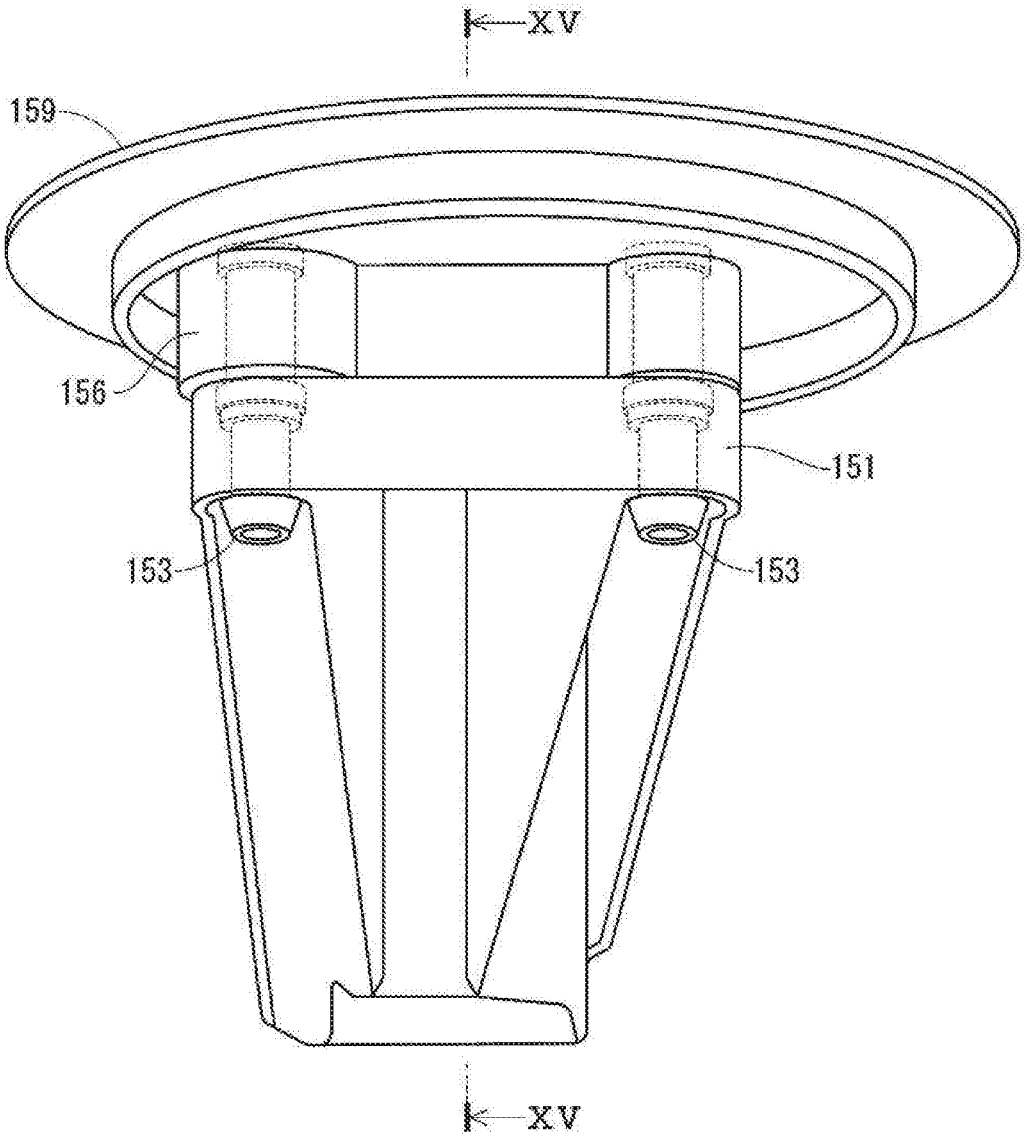
FIG. 14 is a perspective view of a flange, a boss, and a supporting pillar of a fuel supply device in another embodiment.
Figure 15:
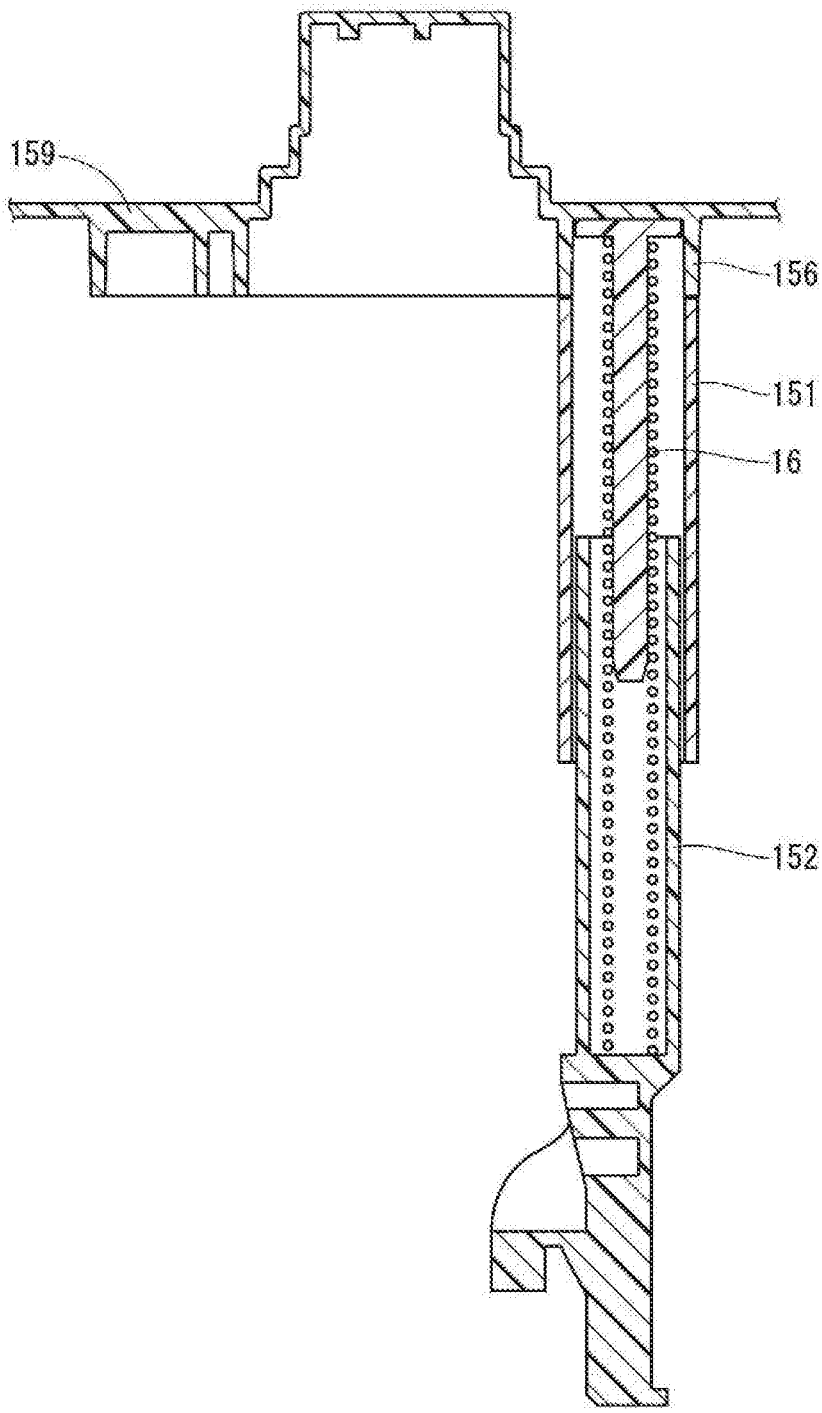
FIG. 15 is a cross-sectional view taken along a line XV-XV in FIG. 14.
Figure 16:
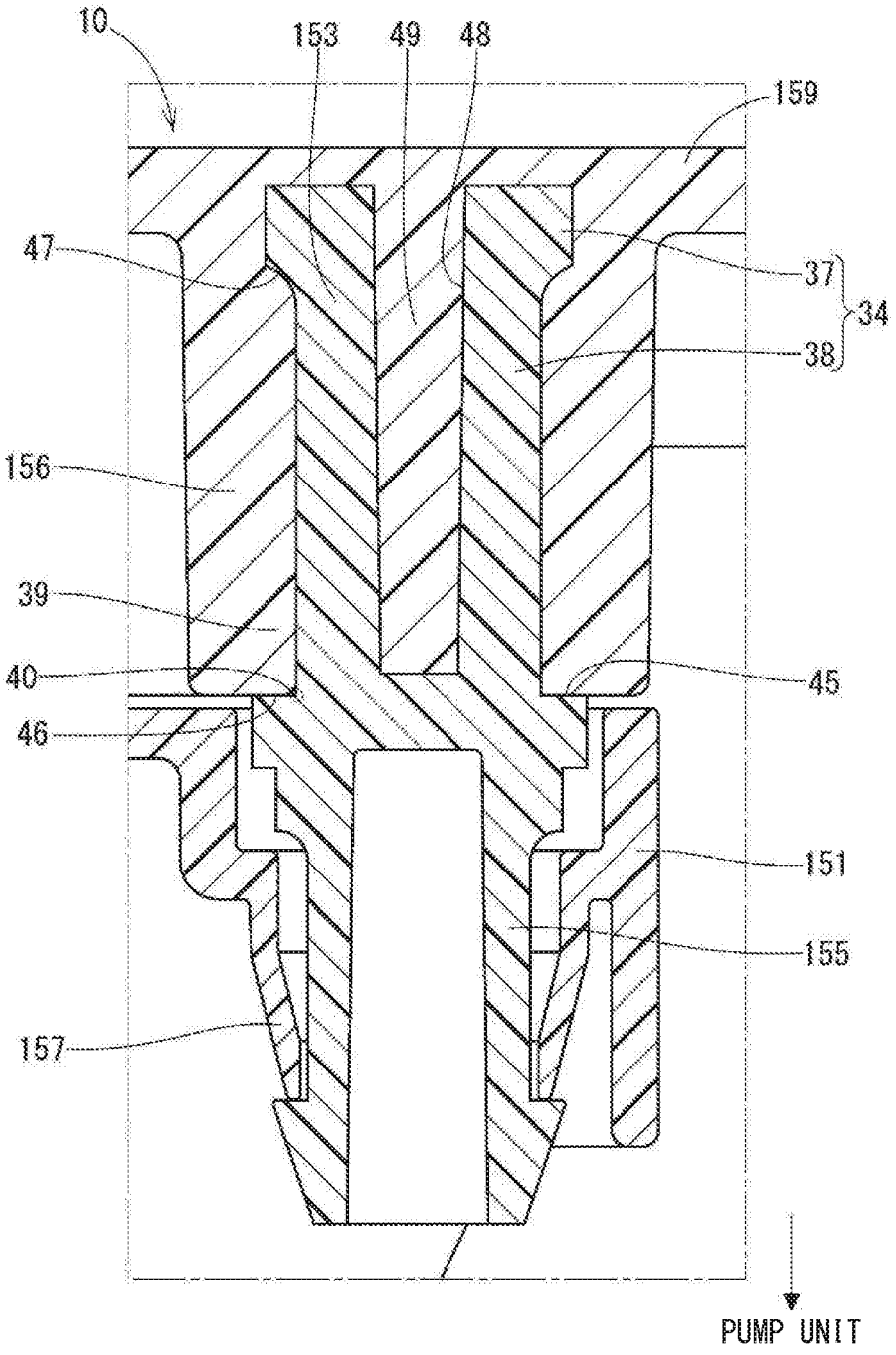
FIG. 16 is a cross-sectional view illustrating portion around the boss in FIG. 14.

In other embodiment, as shown in FIGS. 14 and 15, a supporting pillar (hereinafter, referred as an upper housing 151) may be made of resin material. A fuel supply device in this embodiment includes a lower housing 152 located between the upper housing 151 and the pump unit 11. The lower housing 152 can move relative to the upper housing 151 such that the lower housing 152 is positioned closer to and away from the upper housing 151. A spring 16 is disposed between the upper housing 151 and the lower housing 152. As shown in FIG. 16, the upper housing 151 is fixed to a supporting pillar fixing member 155 of a boss 153 with a snap fit portion 157. The fuel supply device in this embodiment includes two bosses 153 that are insert-molded into a supporter 156 of the flange 159. Each of the bosses 153 may have a fixing structure described in above embodiments.

Figure 17:
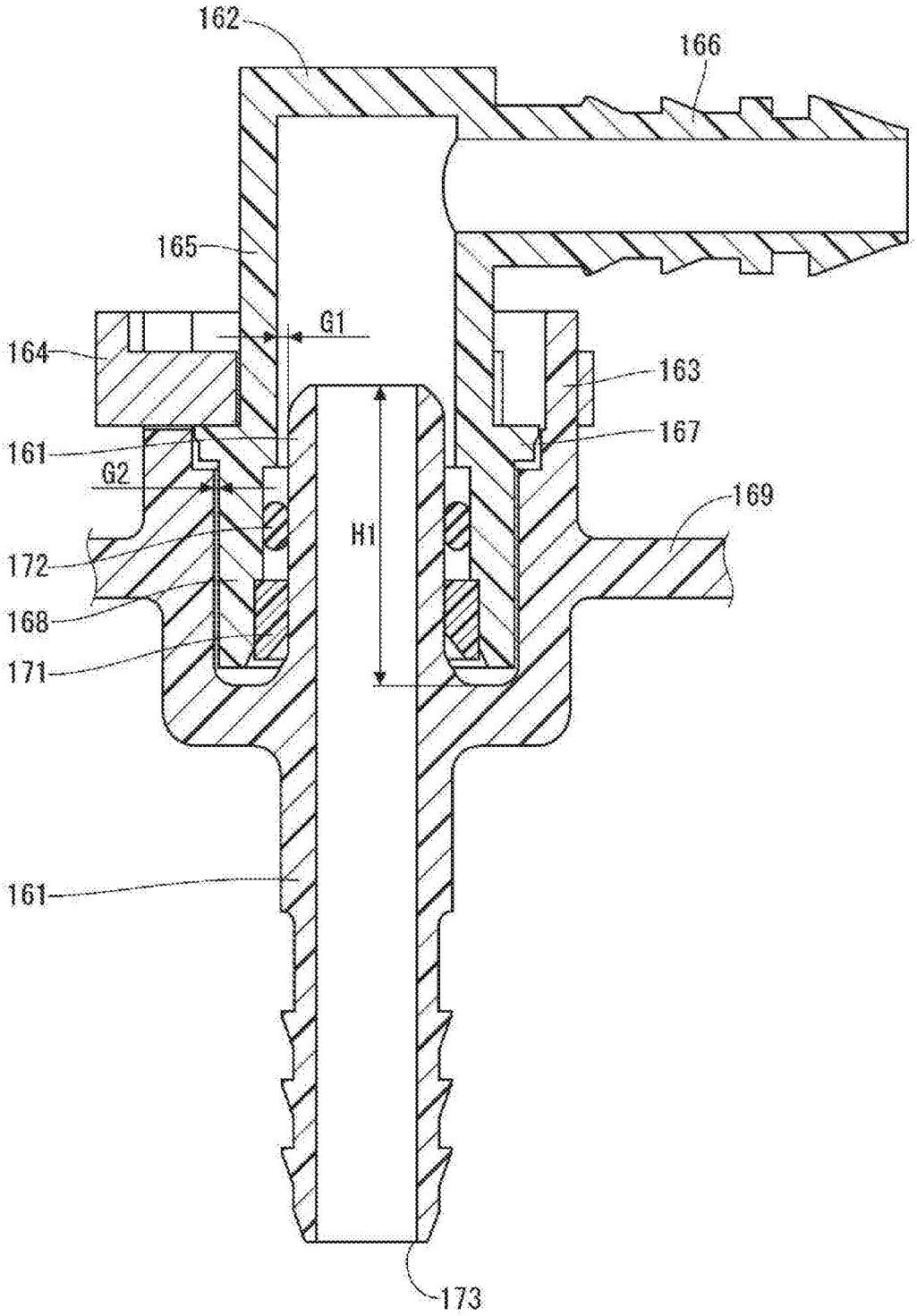
FIG. 17 is a cross-sectional view illustrating a fuel supply pipe of a fuel supply device in another embodiment.

In other embodiment, as shown in FIG. 17, a flange 169 has a fuel supply pipe 161 to which an L shaped pipe 162 is attached. The flange 169 has a clip supporter 163 having a tube shape at an outside of the fuel supply pipe 161 and the L shaped pipe 162 is prevented from slipping out with a clip 164 disposed at the clip supporter 163.

The L shaped pipe 162 has a tube portion 165 to be inserted between the fuel supply pipe 161 and the clip supporter 163 and a connector 166 protruding from an end of the tube portion 165. The tube portion 165 includes a collar 167 at a middle part of the tube portion 165. A spacer 171 and an o ring 172 are disposed in the tube portion 165 at an insertion end 168 in this order from an opening of the tube portion 165 through which the fuel supply pipe 161 is inserted.

Figure 18:
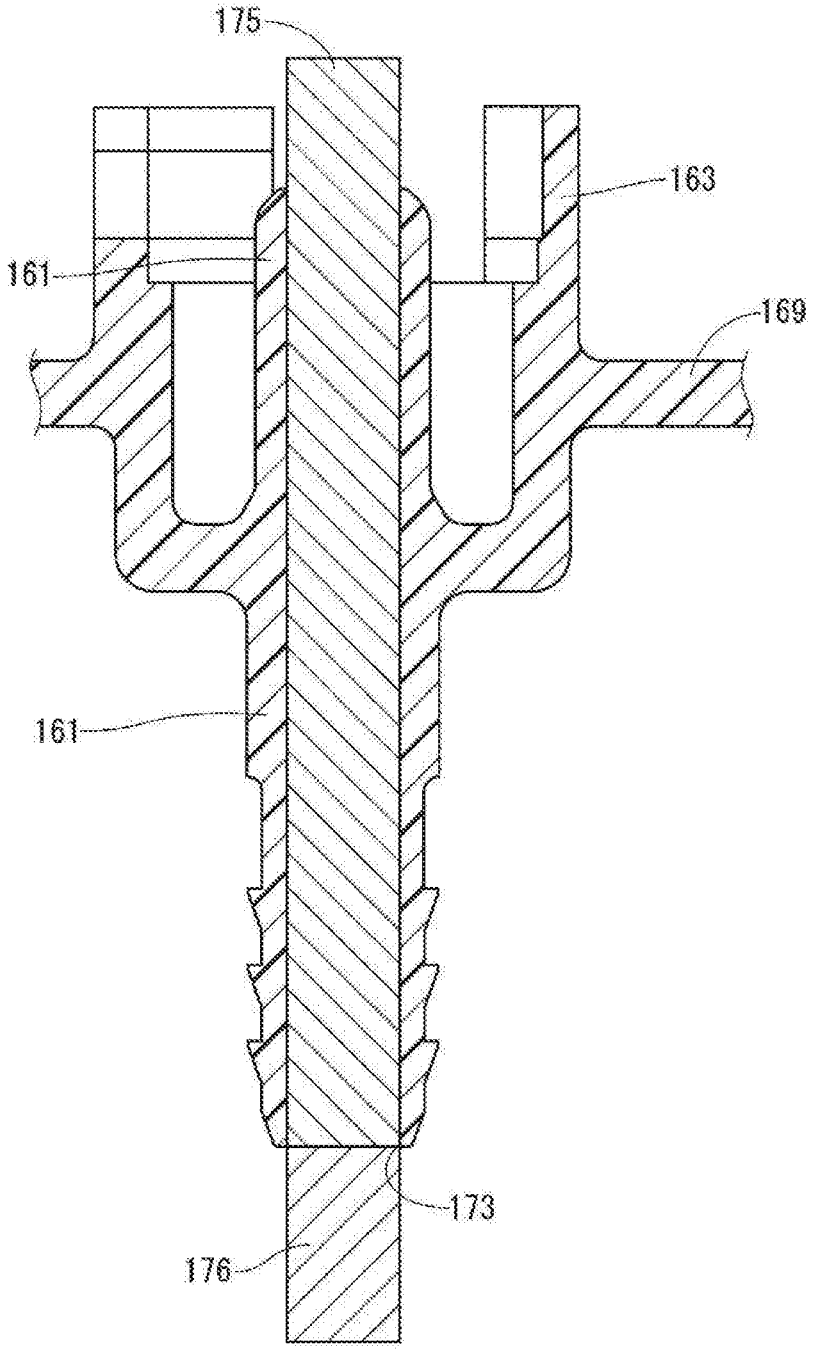
FIG. 18 is a cross-sectional view illustrating a state in which the fuel supply pipe in FIG. 17 is formed.

As shown in FIG. 18, the fuel supply pipe 161 includes a mold facing portion 173 at an end of the fuel supply pipe 161. That is, positions of molds 175 and 176 facing each other when molding the fuel supply pipe 161 are located at the end of the fuel supply pipe 161. Compared to a case in which the mold facing position is located at a middle part in the fuel supply pipe 161, burrs generated when molding the fuel supply pipe 161 can be removed easier. When a material such as PPS that is likely to generate burrs is used as a material of the flange 169, a large advantage can be obtained at manufacturing.

Figure 19:
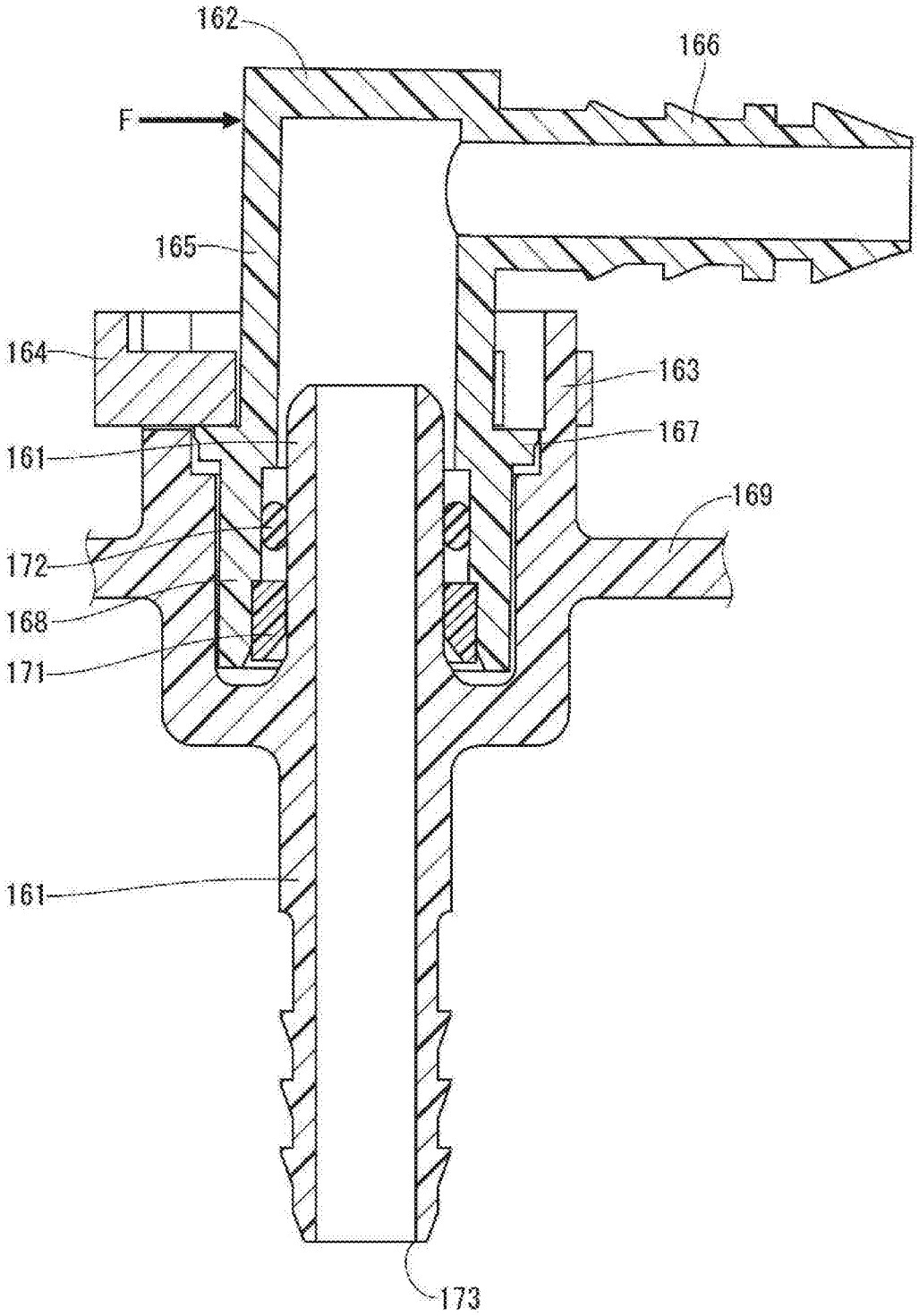
FIG. 19 is a cross-sectional view illustrating a state in which an L-shaped pipe in FIG. 17 is tilted.
Figure 20:
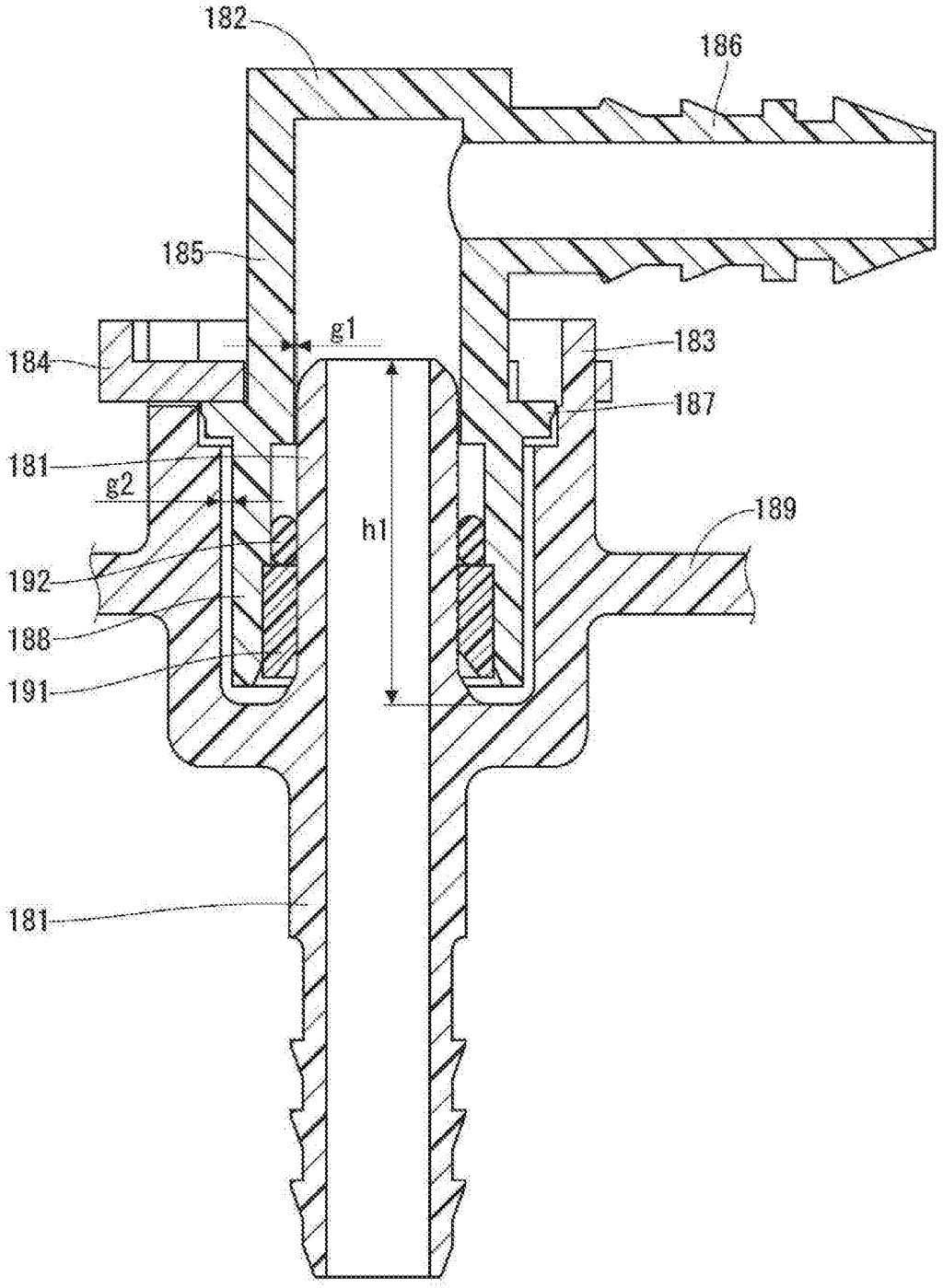
FIG. 20 is a cross-sectional view illustrating portion around a fuel supply pipe of a fuel supply device in a comparative example.
Figure 21:
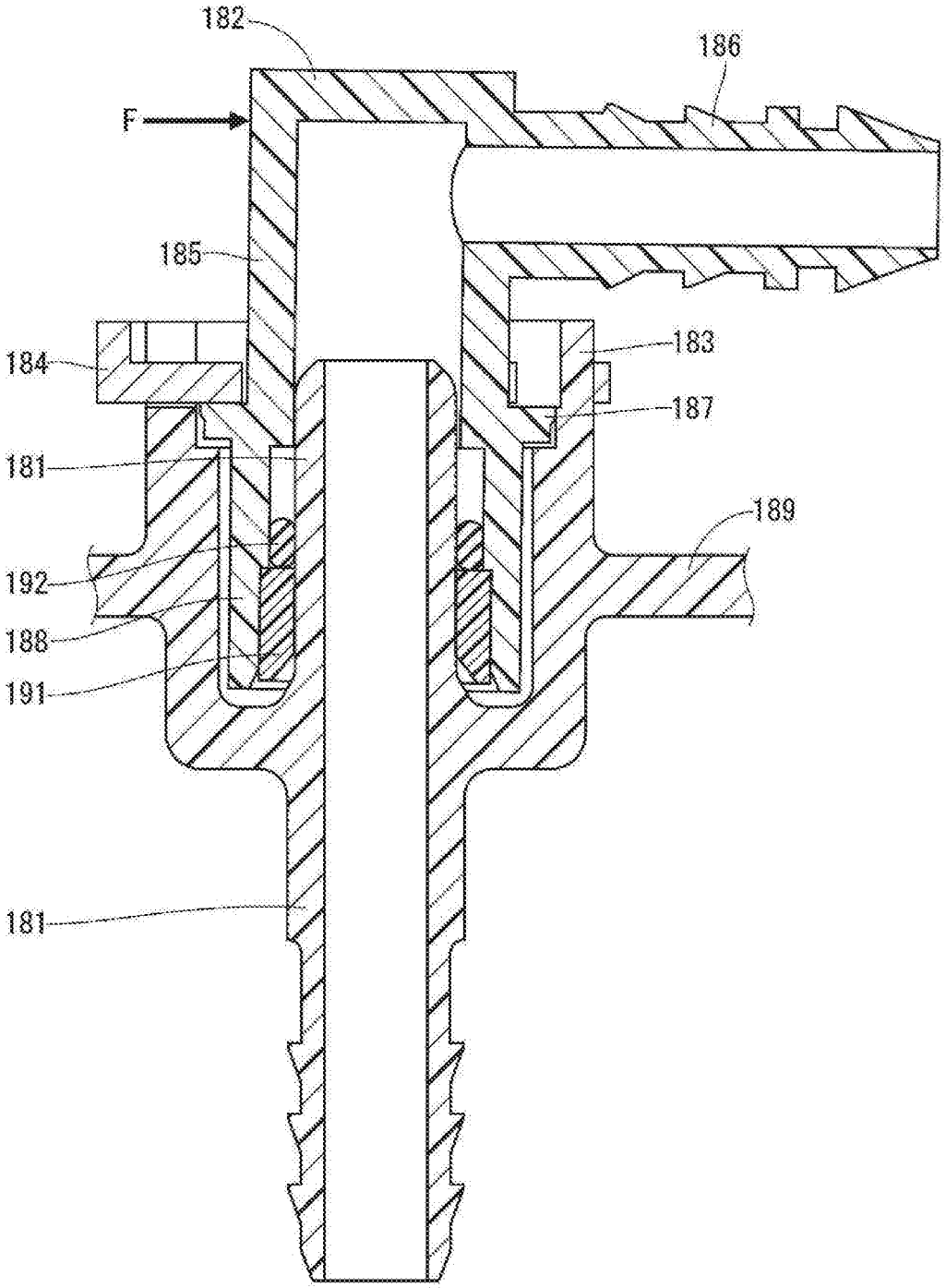
FIG. 21 is a cross-sectional view illustrating a state in which an L-shaped pipe in FIG. 20 is tilted.

Hereinafter, an embodiment shown in FIGS. 17 and 19 is referred as a "present embodiment" and an embodiment shown in FIGS. 20 and 21 is referred as a "comparative example". In the comparative example, when a load F is applied to an L shaped pipe 182 and the L shaped pipe 182 is tilted as shown in FIG. 21, an inner wall of a tube portion 185 of the L shaped pipe 182 contacts with a tip end of a fuel supply pipe 181. Thereby, an excessive moment is generated at the fuel supply pipe 181. When a material having a small breaking elongation such as PPS is used for the fuel supply pipe 181, the fuel supply pipe 181 may be broken and the fuel may leak due to the breakage the fuel supply pipe 181.

In contrast, in this embodiment, a gap G1 between the fuel supply pipe 161 and the L shaped pipe 162 is larger than a gap g1 in the comparative example, a protruding height H1 of the fuel supply pipe 161 that protrudes from the flange 189 is less than a protruding height h1 of the fuel supply pipe 161 in the comparative example, and a gap G2 between the insertion end 168 and the L shaped pipe 162 is smaller than a gap g2 in the comparative example. Thus, when a load F is applied to the L shaped pipe 162 to have the L shaped pipe 162 tilt as shown in FIG. 19 and when the collar 167 and the insertion end 168 come in contact with the inner surface of the L shaped pipe 162, the fuel supply pipe 161 is not in contact with the inner surface of the L shaped pipe 162. As a result, an excessive moment at the fuel supply pipe 161 is restricted from generating.

The clip 164 in the present embodiment has a thickness larger than that in the comparative example, thus a strength of the clip 164 is improved. Since the spacer 171 has a portion reduced in thickness, in the axis perpendicular direction, toward the insertion end 168, the spacer 171 is prevented from being in contact with a tip end of the fuel supply pipe 161 when the L shaped pipe 162 is tilted.

In another example of the fifth embodiment, the flange fixing member of the boss may be welded to the insertion hole of the supporter of the flange, or the stress concentration portion may be formed as a cutout portion. In another example of the sixth embodiment, the stress concentration portion may be formed as a corner of a step or a bottom of a cutout portion.

In other embodiment, the boss may be formed as a different member from the flange while the boss is made of the same kind of material with the flange. In this case, a crack generated at the stress concentration portion is stopped expanding at the boundary between the boss and the flange, thus the crack passing through the flange is restricted from generating and the fuel is prevented from leaking out of the fuel tank. The material of the boss and the flange may be POM, PPS, PPS-I, PPA, PPS-GF, or PPA-GF.

In other embodiment, the recess included by one of the flange fixing member of the boss and the flange and the protrusion included by the other are not necessary disposed.

In other embodiment, the shape of the end portion of the supporting pillar is not limited to the fir tree shape or tapered shape.

In other embodiment, the pump unit may not include the sub tank while the pump unit includes the fuel pump. In other embodiment, the fuel supply device may not include the spring and may be configured as another structure such as a hanging type in which the pump unit is hanging from the flange.

The present disclosure is described based on embodiments. However, the present disclosure is not limited to the embodiments and configurations described in embodiments. The present disclosure includes various alternations and modifications in a range of equivalent. Various combinations and embodiments and various combinations and embodiments to which one element or elements are added are included in the range and technical features of the present disclosure.

What is claimed is:

1. A fuel supply device comprising:

a flange attached to an opening portion of a fuel tank;

a pump unit disposed in the fuel tank and configured to discharge a fuel out of the fuel tank;

a supporting pillar connecting the flange to the pump unit; and a boss fixed to the flange, one end of the supporting pillar being inserted into the boss, wherein a direction perpendicular to an axial direction of the supporting pillar is defined as an axis perpendicular direction, the boss is made of a material different from that of the flange, and the boss includes a stress concentration portion configured to be preferentially broken when a force having a predetermined value or more is applied to the other end of the supporting pillar.

2. The fuel supply device according to claim 1, wherein the material of the boss has a melting temperature equal to or greater than a melting temperature of the material of the flange.

3. The fuel supply device according to claim 1, wherein the material of the boss has a breaking strength less than a breaking strength of the material of the flange.

4. The fuel supply device according to claim 1, wherein the material of the boss has an elastic modulus less than an elastic modulus of the material of the flange.

5. The fuel supply device according to claim 1, wherein the material of the boss has a breaking elongation larger than a breaking elongation of the material of the flange.

6. A fuel supply device comprising:

a flange attached to an opening portion of a fuel tank;

a pump unit disposed in the fuel tank and configured to discharge a fuel out of the fuel tank;

a supporting pillar connecting the flange to the pump unit; and a boss fixed to the flange, one end of the supporting pillar being inserted into the boss, wherein a direction perpendicular to an axial direction of the supporting pillar is defined as an axis perpendicular direction, the boss is formed as a different member from the flange, and the boss includes a stress concentration portion configured to be preferentially broken when a force having a predetermined value or more is applied to the other end of the supporting pillar.

7. The fuel supply device according to claim 1, wherein the boss and an outer surface of the supporting pillar are in contact with each other at a contact portion that has a first position closest to the pump unit, the boss and the flange are in contact with each other at a contact portion that has a second position closest to the pump unit, and the first position is closer to the pump unit than the second position in the axial direction of the supporting pillar.

8. The fuel supply device according to claim 1, wherein the boss and an outer surface of the supporting pillar are in contact with each other at a contact portion that has a third position closest to the flange, the boss and the flange are in contact with each other at a contact portion that has a second position closest to the pump unit, and the third position is closer to the pump unit than the second position in the axial direction of the supporting pillar.

9. The fuel supply device according to claim 1, wherein the stress concentration portion is a portion of the boss that has a smallest outer diameter and that is outside of a press-fit area of the boss in which the supporting pillar is press-fit into the boss.

10. The fuel supply device according to claim 1, wherein the boss has a corner of a step or a bottom of a cutout portion that has a smallest outer diameter and that is outside of a press-fit area of the boss in which the supporting pillar is press-fit into the boss, and the step or bottom serves as the stress concentration portion.

11. The fuel supply device according to claim 1, wherein the boss includes an engaging portion on a side of the stress concentration portion opposite to the pump unit in the axial direction of the supporting pillar, and the engaging portion faces the pump unit and is engaged with the flange.

12. The fuel supply device according to claim 1, wherein the boss includes:

a flange fixing member that is embedded in the flange; and a supporting pillar fixing member that protrudes from the flange toward the pump unit, wherein the supporting pillar fixing member has a contact surface that faces away from the pump unit and is in contact with the flange in the axial direction of the supporting pillar.

* * * * *